US006702414B2

(12) United States Patent
Okuda

(10) Patent No.: US 6,702,414 B2
(45) Date of Patent: Mar. 9, 2004

(54) METHOD FOR DRIVING INK JET RECORDING HEAD AND INK JET RECORDER

(75) Inventor: Masakazu Okuda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/276,405

(22) PCT Filed: May 17, 2001

(86) PCT No.: PCT/JP01/04114

§ 371 (c)(1),
(2), (4) Date: Nov. 15, 2002

(87) PCT Pub. No.: WO01/87617

PCT Pub. Date: Nov. 22, 2001

(65) Prior Publication Data

US 2003/0179254 A1 Sep. 25, 2003

(30) Foreign Application Priority Data

May 18, 2000 (JP) ..... 2000-146992

(51) Int. Cl.[7] ..... B41J 29/38
(52) U.S. Cl. ..... 347/10
(58) Field of Search ..... 347/9–11, 14, 347/19, 68, 69

(56) References Cited

U.S. PATENT DOCUMENTS

| | | | | |
|---|---|---|---|---|
| 5,221,931 A | * | 6/1993 | Moriyama | 347/10 |
| 5,631,675 A | * | 5/1997 | Futagawa | 347/10 |
| 5,764,256 A | * | 6/1998 | Zhang | 347/10 |
| 6,092,886 A | * | 7/2000 | Hosono | 347/10 |
| 6,106,091 A | * | 8/2000 | Osawa et al. | 347/9 |

FOREIGN PATENT DOCUMENTS

| | | |
|---|---|---|
| JP | 53-12138 | 4/1978 |
| JP | 55-17589 | 2/1980 |
| JP | 10-193587 | 7/1998 |
| JP | 2000-117969 | 4/2000 |
| JP | 2000-218778 | 8/2000 |
| WO | WO00/23278 | 4/2000 |

* cited by examiner

*Primary Examiner*—Judy Nguyen
*Assistant Examiner*—An H. Do
(74) *Attorney, Agent, or Firm*—McGinn & Gibb, PLLC

(57) ABSTRACT

To enable fine droplets each having a diameter of 15 $\mu$m or less to be ejected without causing increase of device cost and a device size, and decrease reliability and a manufacturing yield.

A driving waveform driving a piezoelectric actuator includes a first voltage changing process for inflating a pressure generating chamber in a falling time $t_1$, a second voltage changing process for rapidly deflating the pressure generating chamber in a rising time $t_3$ after keeping the fallen voltage during a time $t_2$, a third voltage changing process for rapidly inflating the pressure generating chamber just after the preceding process, and a fourth voltage changing process for compressing the pressure generating chamber just after the preceding process. Hereat, $t_1$ and $t_2$ are set so as to satisfy the following expression:

$$t_2 = t_0 - t_1$$

$$t_0 = \frac{T_c}{2\pi}\tan^{-1}\left[\frac{\sin\left(\frac{2\pi}{T_c}\cdot t_1\right)}{\cos\left(\frac{2\pi}{T_c}\cdot t_1\right)-1}\right].$$

29 Claims, 15 Drawing Sheets

(a)

(b)

(a)

(b)

METHOD FOR DRIVING INK JET RECORDING HEAD AND INK JET RECORDER

TECHNICAL FIELD

The present invention relates to an ink jet recording device, in particular, to a method for driving an ink jet recording head that ejects minute ink droplets from nozzles and prints characters and images, and to an ink jet recording device.

BACKGROUND ART

Concerning an ink jet recording device that ejects minute ink droplets from nozzles and prints characters and images, for example, as disclosed in Japanese Patent Application Laid-Open No. SHO53-12138 and Japanese Patent Application Laid-Open No. HEI10-193587, a drop-on-demand type ink jet is well known, in which a pressure wave (acoustic wave) is generated in a pressure generating chamber filled with ink by using a driving device such as a piezoelectric actuator that converts electric energy into mechanical energy such as vibration, and an ink droplet is ejected from a nozzle connected to the pressure generating chamber.

FIG. 13 is a diagram showing an example of a recording head in an ink jet recording device well known by the above described patent applications, etc. A nozzle 62 for ejecting ink and an ink supply channel 64 for leading ink from an ink tank (not shown) through a common ink chamber 63 are connected to a pressure generating chamber 61. Further, a diaphragm 65 is set at the bottom of the pressure generating chamber.

When ejecting ink droplets, the diaphragm 65 is displaced by a piezoelectric actuator 66 set to the outside of the pressure generating chamber 61, and volume in the pressure generating chamber 61 is changed. Thereby, a pressure wave is generated in the pressure generating chamber 61. By the pressure wave, a part of the ink which fills the inside of the pressure generating chamber 61 is ejected outward through the nozzle 62 as an ink droplet 67. The ejected ink droplet reaches the surface of a recording medium such as recording paper, and forms a recording dot. By repeating the formation of the recording dot based on image data, characters and images are recorded on the recording paper.

In order to acquire high image quality using this kind of ink jet recording head, it is necessary to make the diameter of an ejected ink droplet very small. Namely, in order to obtain a smooth image with low granularity, it is necessary to make the recording dot (pixel) formed on the recording paper as small as possible. For that purpose, the diameter of the ejected ink droplet has to be set smaller.

Generally, when the dot diameter becomes 40 $\mu$m or less, the granularity of the image decreases to a large extent. Further, when it becomes 30 $\mu$m or less, it becomes difficult to visually recognize each dot even at a highlight section of the image, and thereby, the image quality can be drastically improved. The relationship between the ink droplet diameter and the dot diameter depends on the flying speed of the ink droplet (droplet velocity), the physical property of the ink (e.g. viscosity and surface tension), the kind of the recording paper, etc. Nevertheless, the dot diameter generally becomes approximately twice as large as the ink droplet diameter. Therefore, in order to obtain the dot diameter not exceeding 30 $\mu$m, it is necessary to set the ink droplet diameter to 15 $\mu$m or less.

Incidentally, in this specification, the drop diameter is defined as the diameter of one spherical ink droplet in the same amount as the total amount of the ink (including satellites) ejected at a time.

The most effective means of reducing the ink droplet diameter includes a reduction of a nozzle diameter.

However, because of the limit of manufacturing technology, and problems in reliability such as clogging of a nozzle, etc., the lower limit of the nozzle diameter is 20 to 25 $\mu$m for actual use, and thereby, it is difficult to obtain an 15 $\mu$m level ink droplet only by the reduction of the nozzle diameter. Consequently, there have been made some attempts to reduce the ejecting ink droplet diameter by driving methods, and some efficient methods have been proposed.

As a driving method for realizing the ejection of a minute droplet with an ink jet recording head, there is known a driving method in which a pressure generating chamber is once inflated just before ejection, and the ejection is conducted from the state where a meniscus at a nozzle opening section is pulled toward the side of the pressure generating chamber (for example, Japanese Patent Application Laid-Open No. SHO55-17589).

An example of a driving waveform used in this kind of driving method is shown in FIG. 14.

While the relationship between a driving voltage and operation of a piezoelectric actuator varies according to the configuration and the polarized direction of the actuator, it is assumed in this specification that, when the driving voltage is increased, the volume of the pressure generating chamber is reduced, and contrary, when the driving voltage is reduced, the volume of the pressure generating chamber is increased.

The driving waveform shown in FIG. 14 comprises a voltage changing section 141 for inflating the pressure generating chamber and a voltage changing section 142 for subsequently compressing the pressure generating chamber and ejecting ink droplets.

FIGS. 15(*a*) to 15(*d*) are pattern diagrams showing the movement of the meniscus at the nozzle opening section when applying the driving waveform shown in FIG. 14.

In an initial state, the meniscus is formed of a flat shape (FIG. 15(*a*)). When the pressure generating chamber 61 is expanded just before the ejection, the central part of the meniscus is pulled toward the pressure generating chamber 61, and thereby, the shape of the meniscus becomes concave as shown in FIG. 15(*b*).

From this state, when the pressure generating chamber 61 is compressed by the voltage changing section 142, the central part of the meniscus is pushed out of the nozzle 41, and a thin liquid column 43 is formed as shown in FIG. 15(*c*). Subsequently, as shown in FIG. 15(*d*), the tip of the liquid column 43 is separated, and an ink droplet 44 is formed.

The droplet diameter of the ink droplet 44 is approximately the same as that of the formed liquid column 43, and is smaller than that of the nozzle 41. Namely, by using that kind of driving method, it is possible to eject ink droplets smaller than the nozzle in diameter.

Incidentally, as described above, the driving method in which minute droplet ejection is conducted by controlling the meniscus shape just before the ejection will be hereinafter referred to as a "meniscus control method" in this specification.

As described above, by using the meniscus control method, it becomes possible to eject ink droplets smaller than the nozzle in diameter. However, when using the driving waveform as shown in FIG. 14, approximately 25 μm is the smallest limit to the droplet diameter obtained in actuality, which cannot be enough to meet recent increasing needs for higher image quality.

Consequently, the present inventor proposed, in Japanese Patent Application Laid-Open No. HEI10-318443, a driving waveform as shown in FIG. 16 as a driving method for enabling further minute droplets to be ejected. This driving waveform comprises a voltage changing section 151 for pulling in the meniscus just before the ejection, a voltage changing section 152 for compressing the pressure generating chamber and forming the liquid column, a voltage changing section 153 for early separating the droplet from the tip of the liquid column, and a voltage changing section 154 for controlling reverberation of the pressure wave remaining after the ink droplet ejection.

Namely, the driving waveform of FIG. 16 is such that pressure wave control aiming at the early separation of the ink droplet and the reverberation control is added to the conventional meniscus control method, and thereby, it becomes possible to eject an ink droplet having an approximately 20 μm droplet diameter stably.

In addition, the present inventor developed an ejection method utilizing natural vibration of a piezoelectric actuator as a method for ejecting minute droplets each having a droplet diameter of 15 μm or less, and disclosed a driving waveform as shown in FIG. 17 in Japanese Patent Application Laid-Open No. HEI11-20613.

This driving waveform also comprises, as with the driving waveform of FIG. 16, a voltage changing section 161 for pulling in the meniscus just before the ejection, a voltage changing section 162 for compressing the pressure generating chamber and forming the liquid column, a voltage changing section 163 for early separating the droplet from the tip of the liquid column, and a voltage changing section 164 for controlling reverberation of the pressure wave remaining after the ink droplet ejection.

This driving waveform is characterized by setting a voltage changing period $t_3$ of the second voltage changing process and a voltage changing period $t_5$ of the third voltage changing process equal to or less than resonance frequency $T_a$ of the piezoelectric actuator itself. Thus the natural vibration of the piezoelectric actuator itself is excited, and vibration having high frequency is generated in the meniscus. By combining such setting with the above described meniscus control method, droplets smaller than those achieved by the general meniscus control method can be ejected.

PROBLEMS TO BE SOLVED BY THE INVENTION

However, when using the above described driving method utilizing the natural vibration of the piezoelectric actuator in order to acquire smaller ink droplets, the deformation speed of the piezoelectric actuator is increased, and thereby, a problem with ensuring the reliability of the piezoelectric actuator arises.

Further, in order to excite the natural vibration of the piezoelectric actuator, it is necessary to apply a driving waveform having very short rising/falling time to the piezoelectric actuator. Thereby, the current passing through the driving circuit of the piezoelectric actuator increases. As the current passing through the driving circuit increases, the heating value from the circuit also increases as well as cost for the circuit components such as switching IC is driven up, and thereby, countermeasures for heat release is required, which cause the increase in the cost of the driving circuit system and the size of the device.

For the above reasons, the driving method utilizing the natural vibration of the piezoelectric actuator has not been put to practical use yet, and the ejection of minute droplets of 20 μm or less with a low-cost device has been extremely difficult in practice.

Further, another problem in conducting the ejection of the minute droplets each having a droplet diameter of 20 μm or less is an ejection characteristic change caused by production variations. Namely, while the ink jet recording heads are manufactured by micro-fabrication technology and precise assembly technology, the ejection characteristics of the heads are subtly changed because of the variations of the component sizes and manufacturing conditions.

Concretely, changes occur to the resonance frequency and the amplitude of the pressure wave generated in the pressure generating chamber. As described above, the minute droplet ejection by the meniscus control method is a technique in which the ink in the nozzle is controlled with high accuracy. Thereby, the ejection is very sensitive to the changes of the ejection characteristics, and the tolerance of the ejection characteristic becomes very narrow. Therefore, there have been problems that the yield at manufacturing the heads gets worse, and that the manufacturing cost increases to a large extent.

The present invention has been made so as to overcome the above problems, and accordingly, the object of the present invention is to provide a driving method of an ink jet recording head and the device thereof, which enables ejection of minute droplets each having a diameter of 20 μm or less without increasing the device cost and size and decreasing the reliability.

DISCLOSURE OF THE INVENTION

According to the present invention, there is provided a driving method of an ink jet recording head to realize the above objects, for ejecting an ink droplet from a nozzle connected to the pressure generating chamber by applying driving voltage to a driving device, driving the driving device and generating a pressure change in a pressure generating chamber filled with ink, wherein:

a voltage waveform of the driving voltage at least comprises a first voltage changing process for inflating the volume of the pressure generating chamber and a second voltage changing process for subsequently deflating the volume of the pressure generating chamber; and a voltage changing time $t_1$ of the first voltage changing process and a time interval $t_2$ between the finish time of the first voltage changing process and the start time of the second voltage changing process are set so as to satisfy the following relational expression:

$$t_2 = t_0 - t_1$$

$$t_2 = t_0 - t_1 \tag{1}$$

$$t_0 = \frac{T_c}{2\pi}\tan^{-1}\left[\frac{\sin\left(\frac{2\pi}{T_c}\cdot t_1\right)}{\cos\left(\frac{2\pi}{T_c}\cdot t_1\right)-1}\right].$$

Incidentally, $T_c$ is pressure wave resonance frequency in the pressure generating chamber.

The invention set forth in claim 2 is the method in which the relational expression of $t_2$ in claim 1 is substituted with:

$$t_0-t_1-1\ \mu s \leqq t_2 \leqq t_0-t_1+3\ \mu s \quad (2).$$

The purpose of the present invention can be realized by the invention claimed in any one of claims 3 to 12.

Namely, conventionally, the mechanism of the minute droplet ejection by the meniscus control was not totally clarified, and further, the driving waveform was not adequately optimized. By contrast, the present inventor has found that, on the basis of a multitude of ejection observing experiments, the minute droplet ejection becomes insensitive to the variations of the pressure wave resonance frequency and also a minute droplet of 20 μm or less can be ejected by setting specific conditions between the voltage changing time $t_1$ of the first voltage changing process and the time interval $t_2$ from the finish time of the first voltage changing process to the start time of the second voltage changing process.

Thereby, it became possible to eject a minute droplet of 20 μm or less without increasing the device cost and size, and decreasing the device reliability and the production yield.

BRIEF DESCRIPTION OF THE DRAWINGS

FIG. 1(*a*) is a diagram showing a driving waveform of an ink jet recording head, and FIG. 1(*b*) is a graph showing results of examination for variations of droplet diameters when changing $t_2$ in the driving waveform of FIG. 1(*a*);

FIG. 7(*a*) is a circuit diagram which illustrates the ink jet recording head shown in FIG. 13 with an equivalent electric circuit, and FIG. 7(*b*) is a circuit diagram approximate to that shown in FIG. 7(*a*);

FIG. 12(*a*) shows a case where the moving velocity of the liquid surface is fast, and FIG. 12(*b*) shows a case where the moving velocity of the liquid surface is slow;

Figure 4:
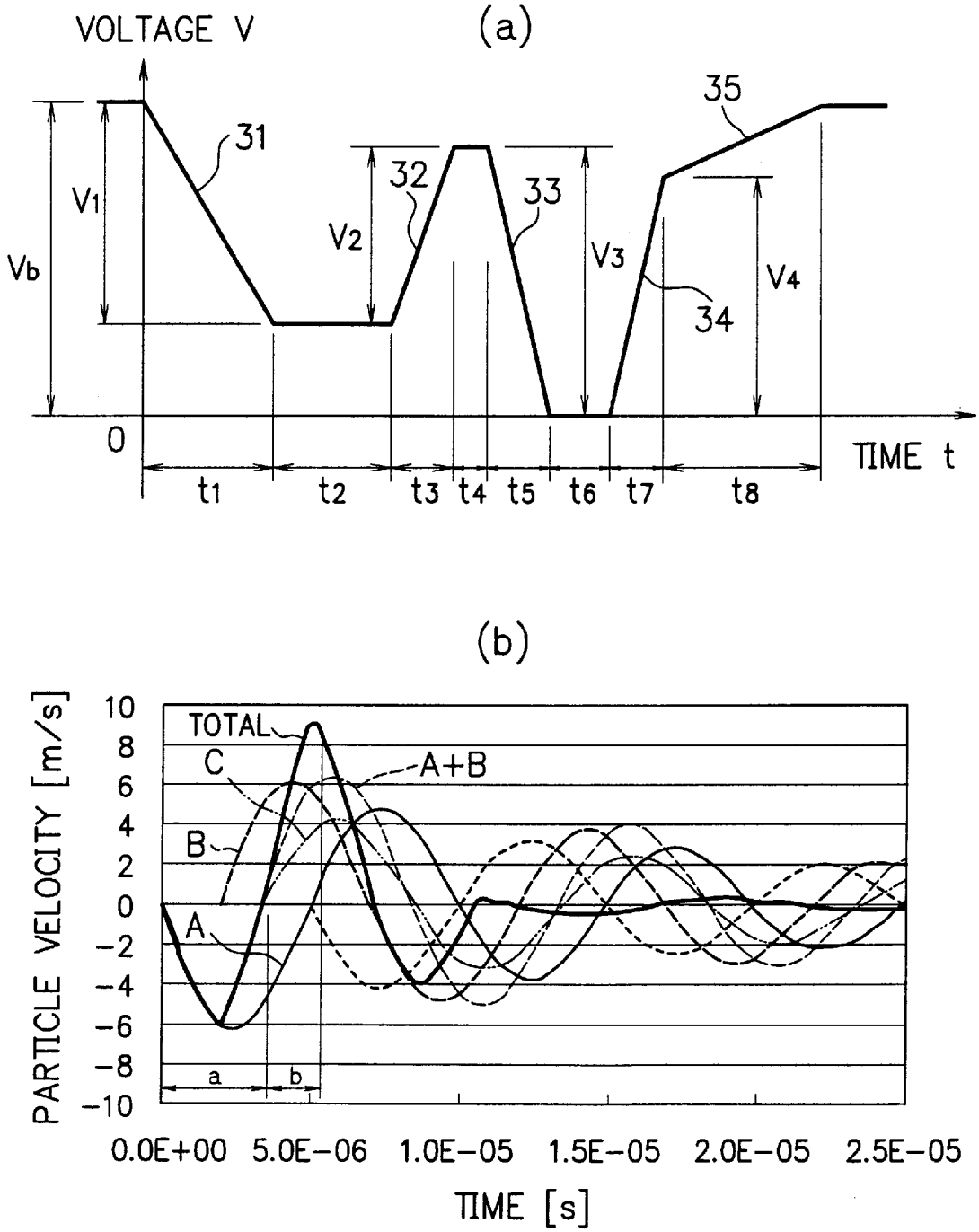
FIGS. 4(*a*) and 4(*b*) are diagrams showing driving waveforms of an ink jet recording head according to a third embodiment of the present invention.

Incidentally, the reference numerals 31, 32, 33 and 34 shown in FIG. 4(*a*) indicate a first voltage changing process, a second voltage changing process, a third voltage changing process, and a fourth voltage changing process, respectively. Moreover, in FIG. 13, the reference numerals 61, 62, 63, 64, 65 and 66 indicate a pressure generating chamber, a nozzle, a common ink chamber, an ink supply channel, a diaphragm, and a piezoelectric actuator (driving device), respectively. Further, the reference numerals 71 shown in FIG. 5 and 81, 81' and 81" shown in FIG. 6 indicate a waveform generating circuit, respectively.

BEST MODE FOR CARRYING OUT THE INVENTION

The best mode for carrying out the present invention will be described below with reference to the drawings.

Explanation of Principle and Function of the Present Invention

First, the principles and functions of the present invention will be explained according to results of theoretical analysis of an ink jet recording head using a lumped parameter circuit model with reference to FIGS. 7 to 12.

Figure 7:
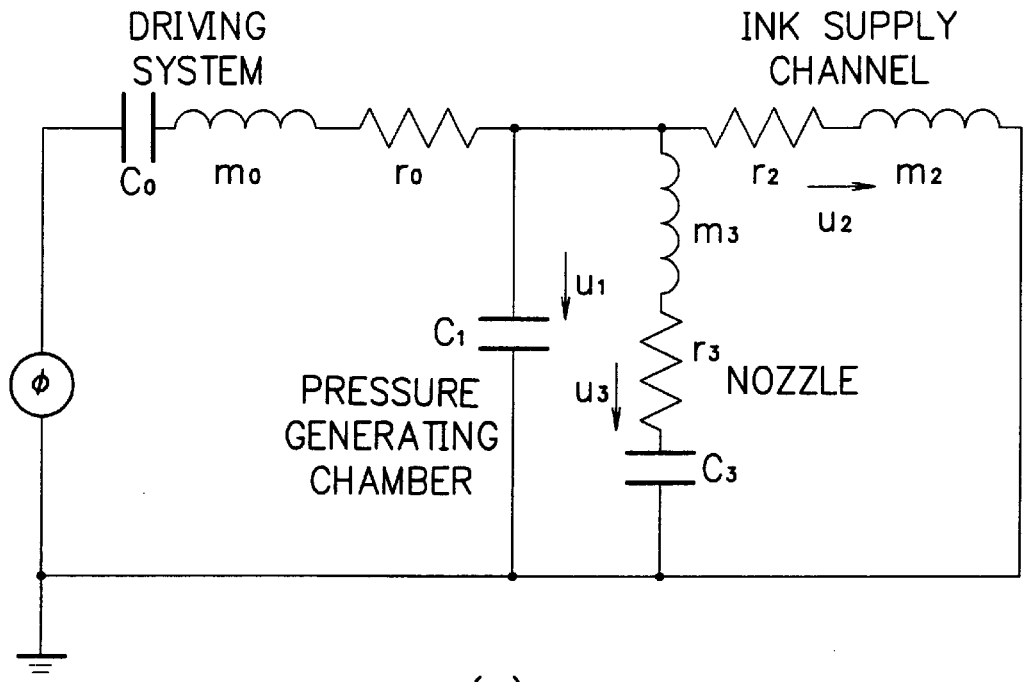
FIGS. 7(*a*) and 7(*b*) are diagrams showing equivalent electric circuits of the ink jet recording head.
Figure 7:
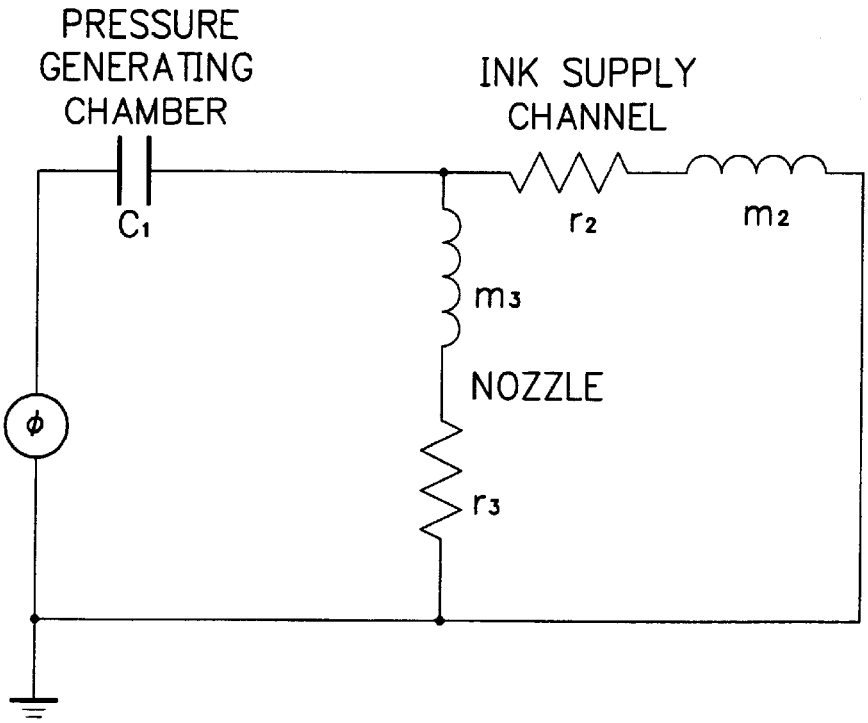

FIGS. 7(*a*) and 7(*b*) are diagrams showing equivalent electric circuits of an ink jet recording head. FIG. 7(*a*) is a diagram which illustrates the ink jet recording head shown in FIG. 13 with an equivalent electric circuit. FIG. 7(*b*) is a diagram showing a circuit approximate to the circuit shown in FIG. 7(*a*).

In FIG. 7(*a*), m indicates inertance [kg/m$^4$], r indicates acoustic resistance [Ns/m$^5$], c indicates acoustic capacitance [m$^5$/N], u indicates a volume velocity [m$^3$/s], and $\phi$ indicates pressure [Pa]. The indexes 0, 1, 2 and 3 mean a driving section, a pressure generating chamber, an ink supply channel, and a nozzle, respectively.

In the circuit shown in FIG. 7(*a*), when a laminated piezoelectric actuator having high rigidity is used for a piezoelectric actuator, the inertance $m_0$, the acoustic resistance $r_0$, and the acoustic capacitance $c_0$ in a driving section can be neglected.

Further, while analyzing a pressure wave, acoustic capacitance $c_3$ at the nozzle can be also neglected. Thereby, the circuit of FIG. 7(*a*) can be approximated by that of FIG. 7(*b*).

Figure 8:
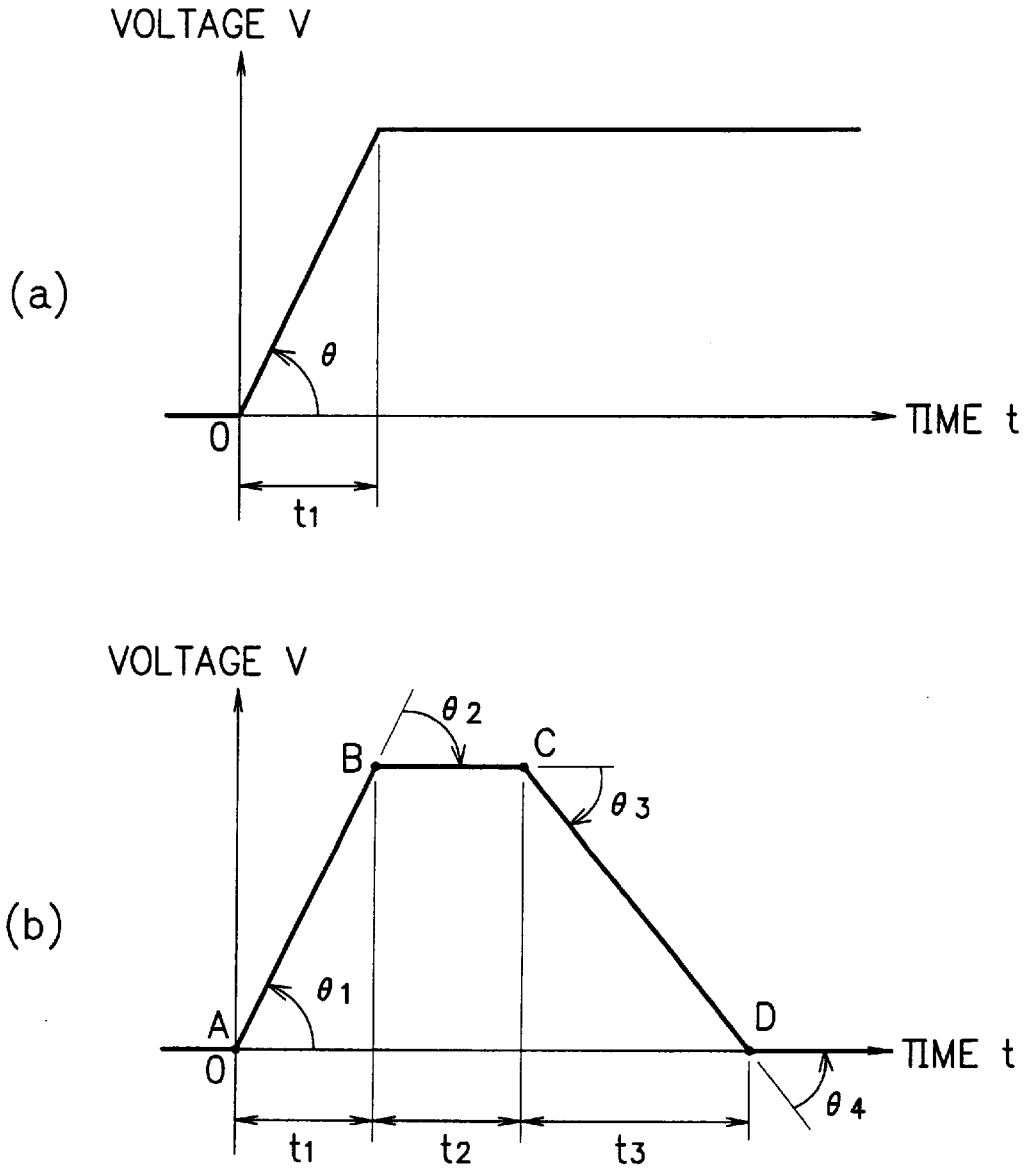
FIGS. 8(*a*) and 8(*b*) are diagrams for explaining a relationship between a driving waveform and a particle velocity at a nozzle section, which are examples of driving waveforms inputted into the circuit of FIG. 7(*b*)

Assuming that relationships of $m_2=k\cdot m_3$ and $r_2=k\cdot r_3$ are established between the inertance at the ink supply channel and that at the nozzle and between the acoustic resistance at the supply channel and that at the nozzle, respectively, in the circuit analysis of a case of inputting a driving waveform having a rising angle θ as shown in FIG. 8(*a*), a particle velocity $v_3'$ at the nozzle section within a time $0 \leqq t \leqq t_1$ is represented as the following expression (3) ($A_3$ indicates the area of the nozzle opening):

$$v_3'(t,\theta) = \frac{c_1 \tan\theta}{A_3\left(1+\frac{1}{k}\right)}\left[1 - \frac{w}{E_c}\exp(-D_c \cdot t)\sin(E_c \cdot t - \phi_0)\right] \quad (0 \le t \le t_1) \tag{3}$$

$$E_c = \sqrt{\frac{1+\frac{1}{k}}{c_1 m_3} - D_c^2}$$

$$D_c = \frac{r_3}{2m_3}$$

$$w^2 = \frac{1+\frac{1}{k}}{c_1 m_3}$$

$$\phi_0 = \tan^{-1}\left(\frac{E_c}{D_c}\right).$$

The particle velocity in the case of using the driving waveform having a complex shape as shown in FIGS. 8(*b*) and 9, respectively, can be found by superposing particle velocities arising at each of the nodes (A, B, C and D) of the driving waveform. Namely, the particle velocity $v_3$ arising at the driving waveform shown in FIGS. 8(*b*) and 9, respectively, is represented as the following expression (4):

$$\begin{aligned}
v_3(t) &= v_3'(t,\theta_1) \quad (0 \le t < t_1) \\
v_3(t) &= v_3'(t,\theta_1) + v_3'(t-t_1,\theta_2) \quad (t_1 \le t < t_1+t_2) \\
v_3(t) &= v_3'(t,\theta_1) + v_3'(t-t_1,\theta_2) + \\
&\quad v_3'(t-t_1-t_2,\theta_3)(t_1+t_2 \le t < t_1+t_2+t_3) \\
v_3(t) &= v_3'(t,\theta_1) + v_3'(t-t_1,\theta_2) + \\
&\quad v_3'(t-t_1-t_2,\theta_3) + \\
&\quad v_3'(t-t_1-t_2-t_3,\theta_4) \quad (t \ge t_1+t_2+t_3).
\end{aligned} \tag{4}$$

The driving waveform of FIG. 9 comprises a first voltage changing process 111 for inflating the pressure generating chamber and pulling the meniscus toward the pressure generating chamber, and a second voltage changing process 112 for subsequently compressing the pressure generating chamber and pushing the meniscus toward the outside of the nozzle.

Figure 9:
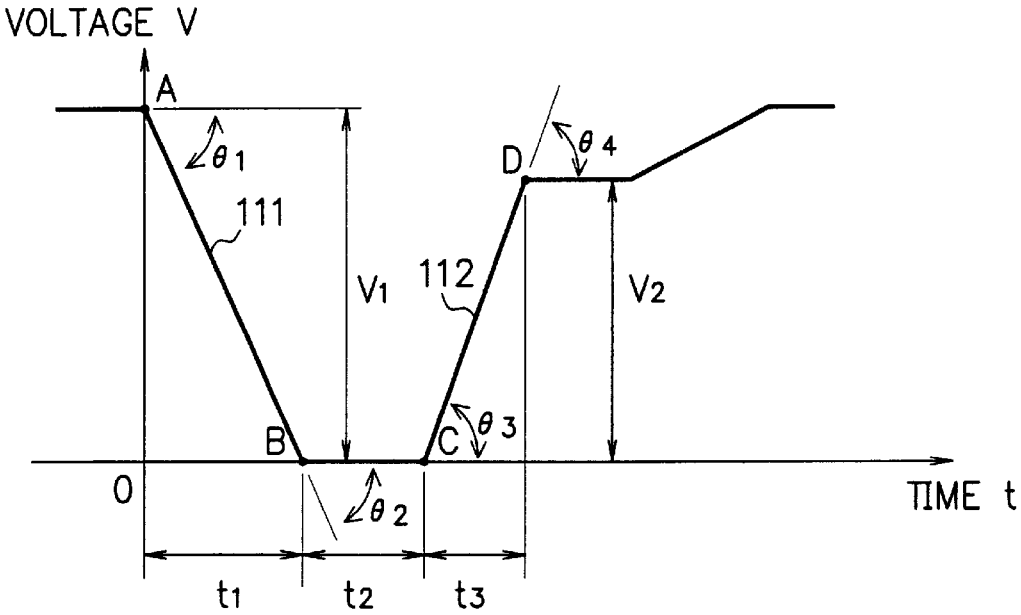
FIG. 9 is a diagram for explaining a relationship between a driving waveform and a particle velocity at a nozzle section, which is another example of a driving waveform inputted into the circuit of FIG. 7(*b*)
Figure 10:
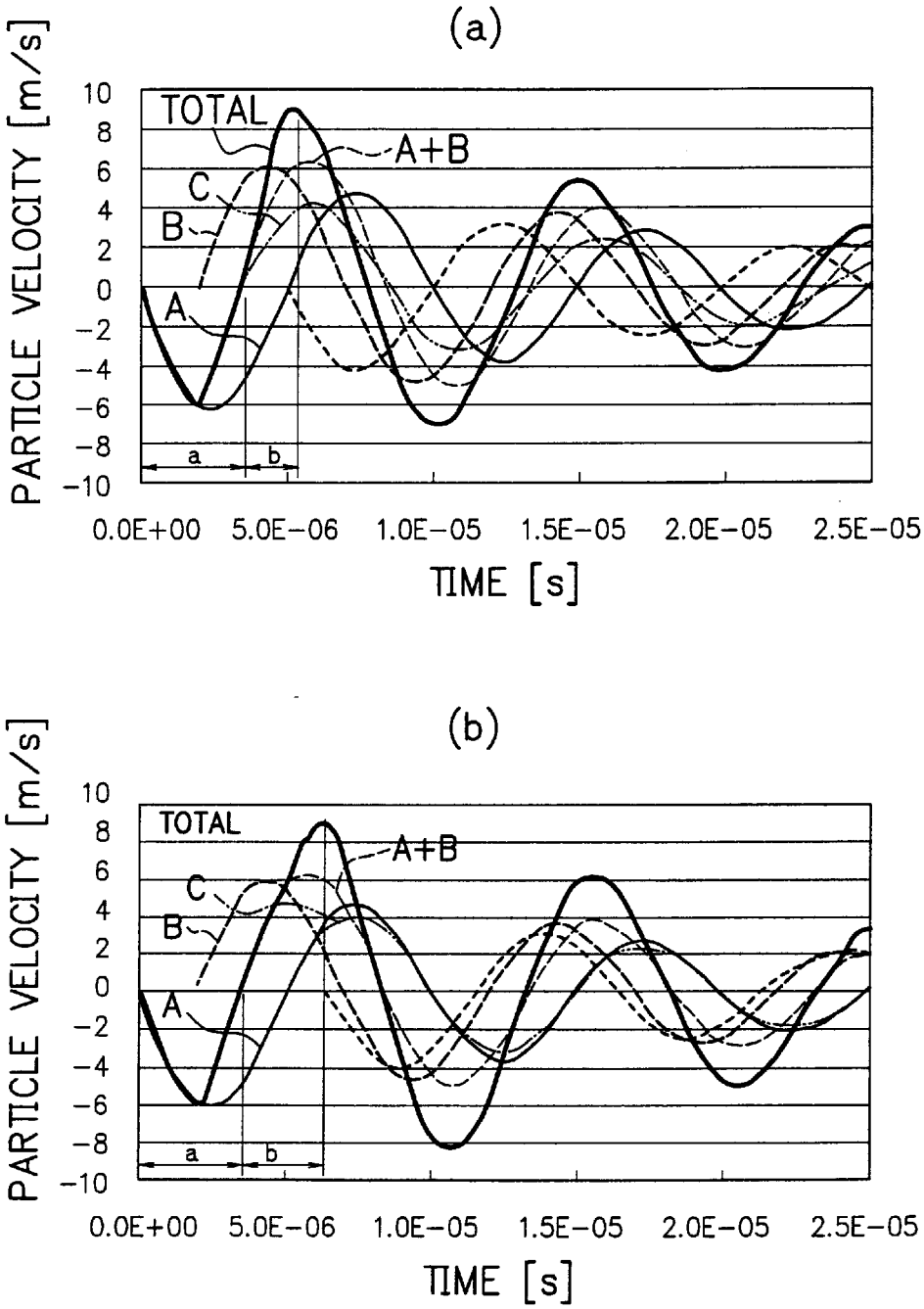
FIGS. 10(*a*) and 10(*b*) are graphs showing results of calculation of a particle velocity $v_3$ for the driving waveform shown in FIG. 9 using an expression (12)

FIGS. 10(*a*) and 10(*b*) show results of calculation for finding the particle velocity $V_3$ for the driving waveform of FIG. 9 using the expression (10) (only in consideration of the vibration components of the expression (1)). In FIGS. 10(*a*) and 10(*b*), thin lines indicate particle velocities arising at each of the nodes A, B, C and D. A heavy line indicates a particle velocity, which is found by superposing the particle velocities of each of the nodes, namely, the heavy line indicates particle velocity variations actually arising in the meniscus.

The vibration components of the particle velocities $v_A$, $v_B$ and $v_C$ generated at the nodes A, B and C are represented as the following expression (5), respectively. Incidentally, in the following explanation, the decrescence of the particle velocities is negligible and thus neglected.

$$\begin{aligned}
v_A &= a_A \sin\left(\frac{2\pi}{T_c}\cdot t + \phi_A\right) \\
&= a_A \sin\left(\frac{2\pi}{T_c}\cdot t + \pi\right) \quad (t > 0) \\
v_B &= a_B \sin\left(\frac{2\pi}{T_c}\cdot t + \phi_B\right) \\
&= a_B \sin\left(\frac{2\pi}{T_c}\cdot t + \frac{2\pi}{T_c}\cdot t_1\right) \quad (t > t_1) \\
v_C &= a_C \sin\left(\frac{2\pi}{T_c}\cdot t + \phi_C\right) \\
&= a_C \sin\left(\frac{2\pi}{T_c}\cdot t + \frac{2\pi}{T_c}\cdot (t_1+t_2)\right) \quad (t > t_1+t_2)
\end{aligned} \tag{5}$$

Here, $a_A$, $a_B$ and $a_C$ are amplitudes of the respective particle velocities, and $a_A = a_B$ (namely, the angle variations in the driving waveform are equal to each other).

Further, $\phi_A$, $\phi_B$ and $\phi_C$ are initial phases of the respective particle velocity changes. $T_c$($T_c = 2\pi/E_c$) is resonance frequency of the pressure wave.

By the superposition of the sinusoidal waves, the particle velocity during $t_1 < t < (t_1+t_2)$ is represented as the following expression (6).

$$\begin{aligned}
V_{A+B} &= a_{A+B}\sin(E_c \cdot t + \phi_{A+B}) \\
a_{A+B} &= \sqrt{a_A^2 + a_B^2 + 2a_A a_B \cos(\phi_A - \phi_B)} \\
&= a_A\sqrt{2\{1+\cos(\phi_A - \phi_B)\}} \\
\tan\phi_{A+B} &= \frac{a_A \sin\phi_A + a_B \sin\phi_B}{a_A \cos\phi_A + a_B \cos\phi_B} \\
&= \frac{\sin(E_c \cdot t_1)}{\cos(E_c \cdot t_1) - 1}
\end{aligned} \tag{6}$$

superposed on the particle velocity represented by the above expression. Hereat, when the phase $\phi_C$ of the particle velocity arising at the node C corresponds to the phase $\phi_{A+B}$ of the above expression, the amplitude during $t > (t_1+t_2)$ is maximized. Namely, if $t_2$ is set as the following expression (7);

$$t_2 = \frac{T_c}{2\pi}\tan^{-1}\left[\frac{\sin\left(\frac{2\pi}{T_c}\cdot t_1\right)}{\cos\left(\frac{2\pi}{T_c}\cdot t_1\right) - 1}\right] - t_1, \tag{7}$$

the amplitude of the particle velocity during $t < (t_1+t_2)$ becomes the largest.

Figure 11:
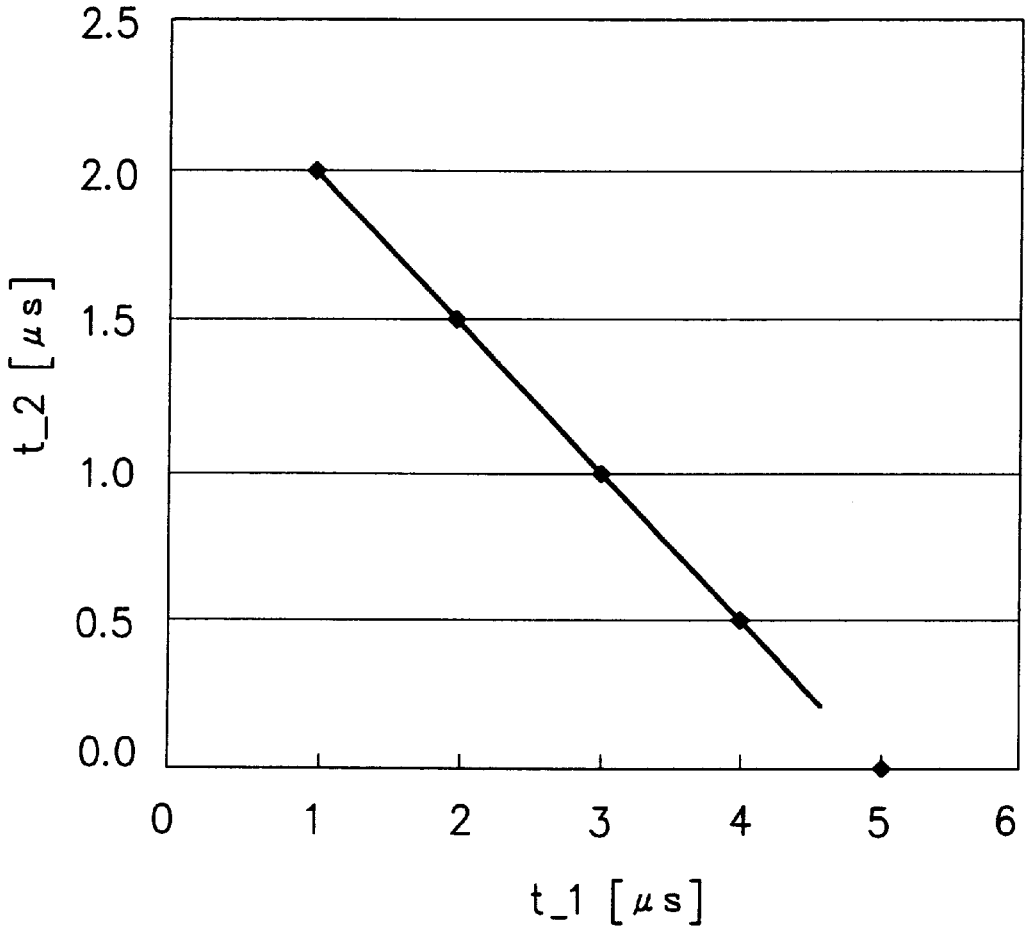
FIG. 11 is a graph showing results of plotting values of $t_2$ having the maximum particle velocity amplitude on the basis of the expression (1)

FIG. 11 shows results of plotting the values of $t_2$ whose amplitude of the particle velocity is maximized on the basis of the above described expression (1) (calculated as $T_c = 10$ μs). The results show that the optimum $t_2$ exists according to the set value of $t_1$.

As the above expression, when $t_1$ and $t_2$ are set according to the expression (1), in the time period $t > (t_1+t_2)$, the amplitude of the particle velocity increases drastically, and rapid speed change occurs (refer to FIG. 10(*a*)).

The shape change of the meniscus when the above-described rapid speed change arises will be explained in the following in reference to FIGS. 10 and 12.

When the change of the particle velocity as shown in FIG. 10(*a*) arises at the meniscus, first, the meniscus is pulled toward the pressure generating chamber in the time period a, and the concave-shaped meniscus is formed.

Subsequently, the meniscus is pushed toward the outside of the nozzle in the time period b.

As described above, when extrusion pressure is applied to the meniscus in the state where the meniscus is formed in concave shape, a thin liquid column is formed at the central part of the nozzle. As there had been no antecedent study about the formation mechanism of the liquid column in detail, the present inventor made it appear that, by ejection observing experiments and fluid analysis, the thickness of the formed liquid column depends on the speed of the liquid surface at the time of pushing the meniscus.

Figure 12:
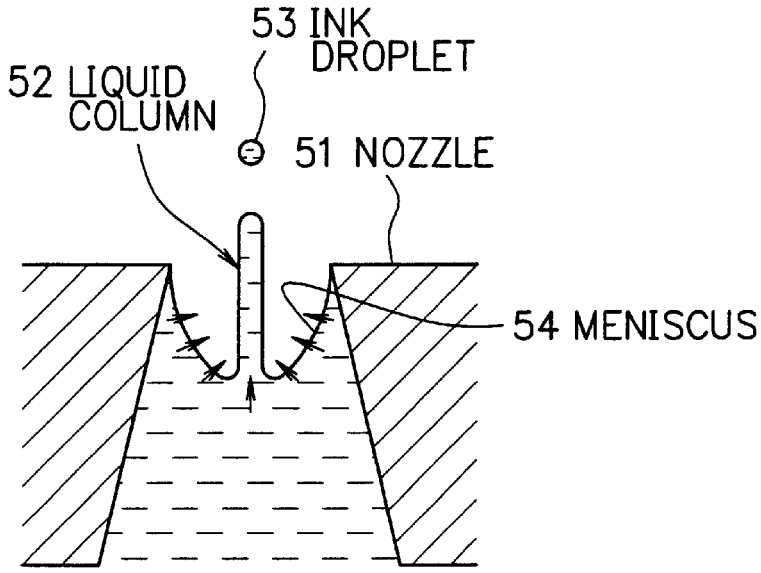
FIGS. 12(*a*) and 12(*b*) are diagrams for explaining a state where a liquid column is formed at a central section of a liquid surface in a nozzle.
Figure 12:
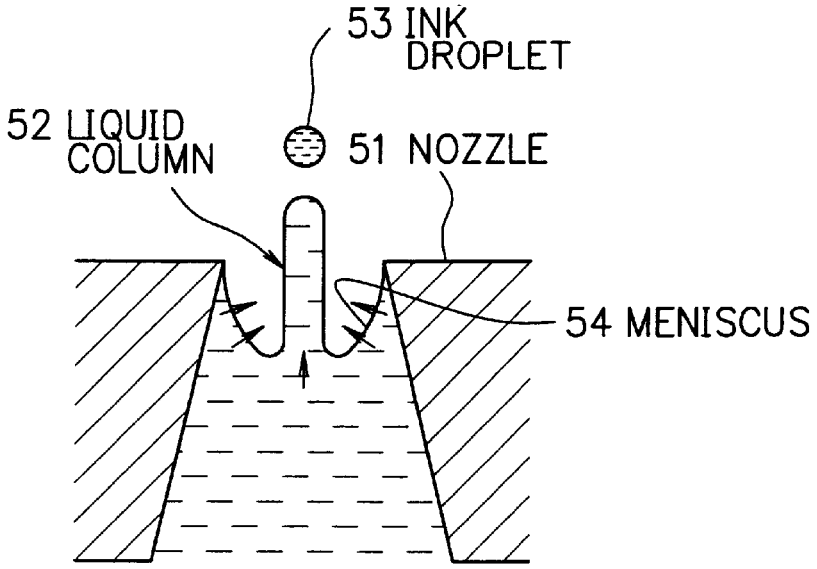

Namely, when pressure is applied to the concave-shaped meniscus in the outward direction, each part of the meniscus tries to move in the normal direction of the liquid surface as shown in FIGS. 12(*a*) and (*b*). Accordingly, plenty of ink concentrates at the central part of the nozzle, and a liquid column is formed at the central part of the nozzle by the local increase of the volume.

Hereat, when the moving speed of the liquid surface is rapid (in the case of FIG. 12(*a*)), the speed of the increase of the volume at the central part of the nozzle becomes rapid. Thereby, a very thin liquid column is formed with a rapid growth rate.

On the other hand, when the moving speed of the liquid surface is slow (in the case of FIG. 12(*b*)), the speed of the increase of the volume decreases. Thereby, the liquid column becomes thick, and the growth rate gets down.

Incidentally, the droplet diameter of the ink droplet ejected by the meniscus control system corresponds to the thickness of the formed liquid column. In addition, the flying speed (droplet velocity) of the ink droplet corresponds to the growth rate of the liquid column. Therefore, in order to eject minute ink droplets at a high speed, it becomes important conditions to increase the moving speed of the liquid surface when applying extrusion pressure, and to generate the rapid increase of the volume at the central part of the nozzle.

From the above viewpoints, as shown in FIG. 10(*a*), to set $t_1$ and $t_2$ according to the expression (1) is advantageous to eject minute droplets. Namely, under these conditions, the phase of the particle velocity arising at the node C corresponds to that of the particle velocity caused by the nodes A and B in the driving waveform shown in FIG. 9. Thereby, the amplitude of the particle velocity during a time period $t>(t_1+t_2)$ increases rapidly, and the moving speed of the liquid surface becomes faster. Therefore, the rapid increase of the volume at the central part of the nozzle occurs, and a thin liquid column is formed. Accordingly, it becomes possible to eject very fine ink droplets at a high speed.

On the other hand, when $t_1$ and $t_2$ in the driving waveform shown in FIG. 9 do not meet the condition of the expression (1), the phases of the particle velocities arising at the nodes A, B and C do not correspond with each other. Namely, as shown in FIG. 10(*b*), the phase of the synthetic wave of the nodes A+B does not correspond to the phase of the wave of the node C. Thereby, the particle velocity found by superposing those waves (denoted by the heavy line) changes very slowly.

Under such a condition, it is difficult to generate the rapid increase of the volume at the central part of the nozzle. Thereby, the thickness of the liquid column to be formed becomes large, and consequently, the diameter of the ink droplet to be ejected becomes large, and the droplet velocity becomes slow (refer to FIG. 12(*b*)). Namely, it becomes impossible to obtain a minute droplet of 20 μm or less that is required for high quality image recording.

Further, as described above, by matching the phase of the synthetic wave of the nodes A+B with the phase of the particle velocity arising at the node C, it becomes possible to ensure high robustness (insensitivity) to the variations of the pressure wave resonance frequency. This is because the amplitude of the synthetic wave of two sinusoidal waves depends on the phase difference between the two sinusoidal waves, and the rate of change of the amplitude caused by the phase difference is minimized when the phase difference is in the vicinity of 0 (refer to the expression (12)).

Namely, by holding the correspondence between the phase of the particle velocity arising at the nodes A+B and the phase of the particle velocity arising at the node C, even when the resonance frequency of the pressure wave deviates from the set value and thereby phase difference arises therebetween, the amplitude variations of the synthetic wave can be kept small and the influence on the ejection characteristics can be kept to the minimum.

As described above, by setting the voltage changing period of the first voltage changing process in the driving waveform ($t_1$ in FIG. 9) and the time interval between the finish time of the first voltage changing process and the start time of the second voltage changing process ($t_2$ in FIG. 9) according to the expression (1), it becomes possible to ensure high robustness to the variations of the pressure wave resonance frequency and to eject ink droplets having very small diameter at a high speed.

Incidentally, in the driving method of the ink jet head of the present invention, there is no need to make extra alterations to the driving circuit and the piezoelectric actuator, etc. Thereby, it is possible to prevent increases of the device cost and device size, and deterioration of the device reliability.

Embodiments of the Ink Jet Recording Device

Figure 5:
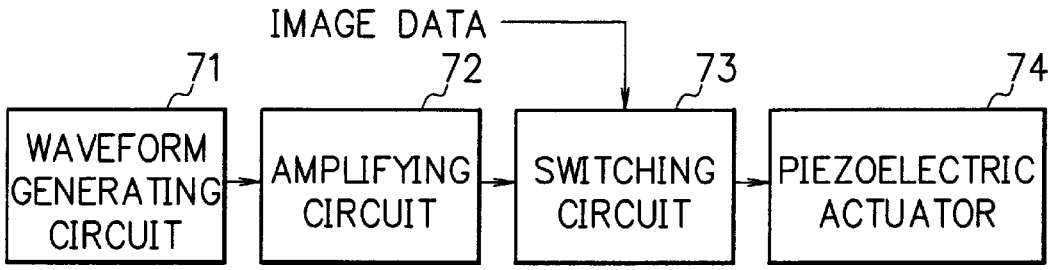
FIG. 5 is a diagram showing an example of a driving circuit in the case of fixing a diameter of an ejected ink droplet.
Figure 6:
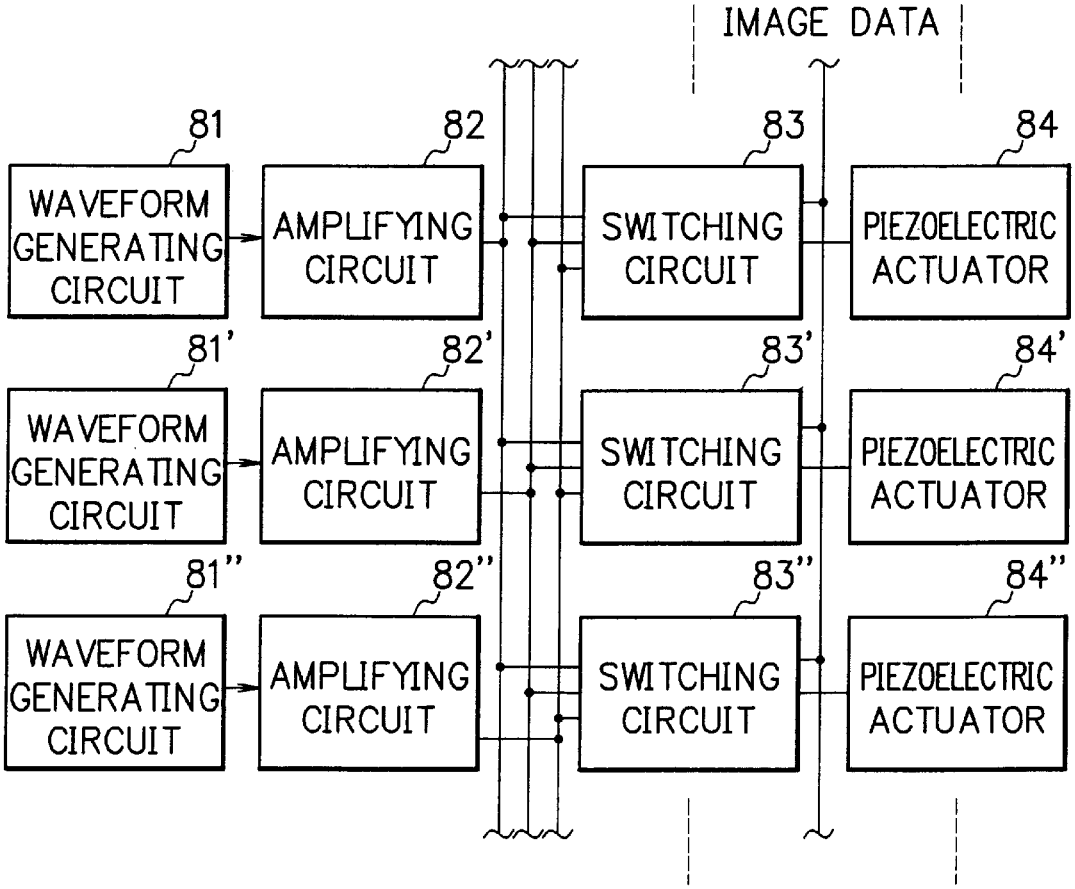
FIG. 6 is a diagram showing a basic configuration of a driving circuit in the case of switching the diameter of the ejected ink droplet between multiple levels, namely, in the case of executing a droplet diameter modulation.
Figure 13:
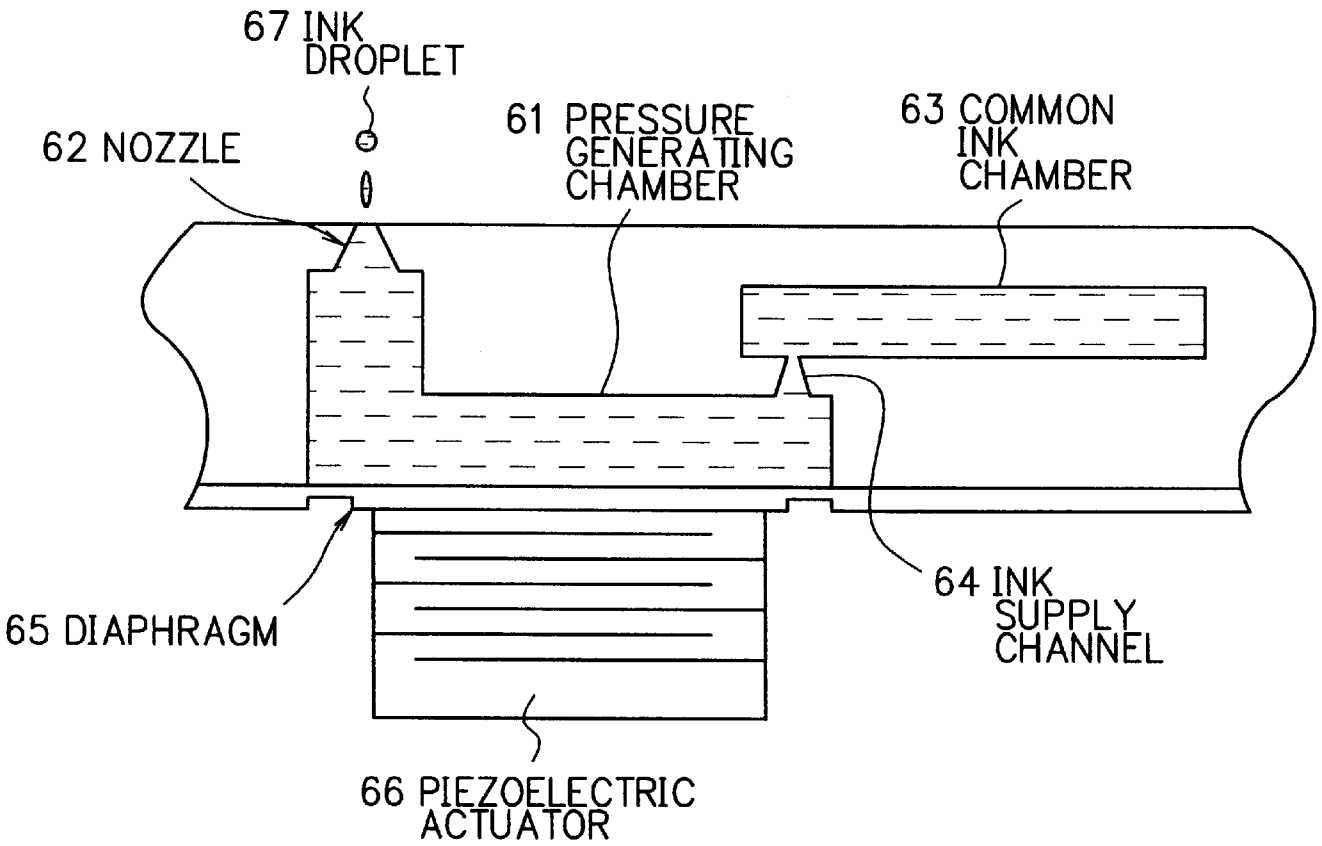
FIG. 13 is a diagram showing an example of a recording head in a well-known ink jet recording device.
Figure 14:
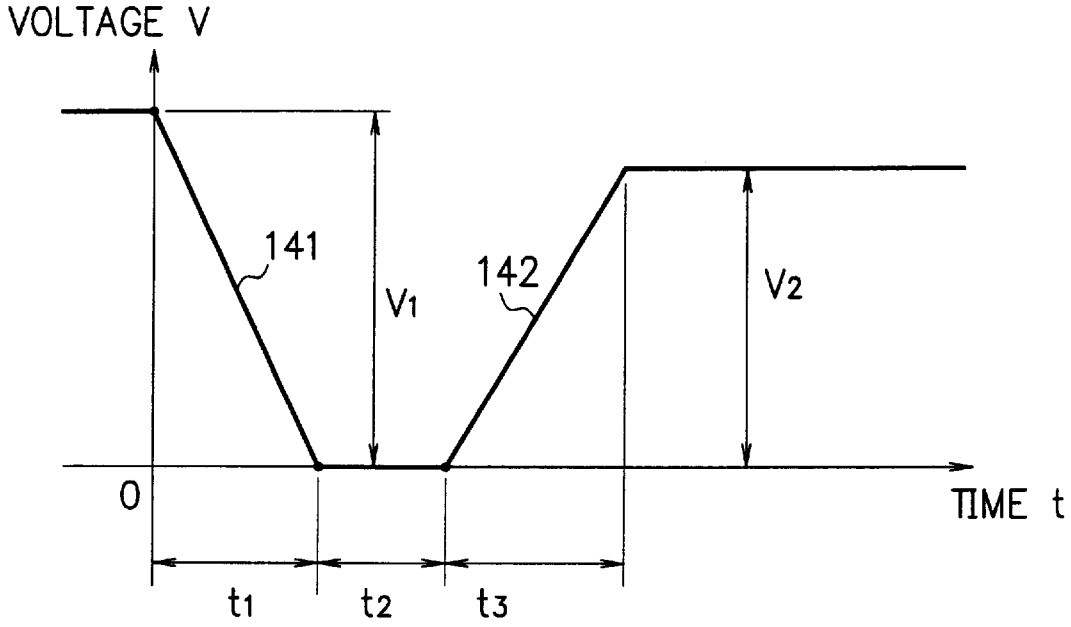
FIG. 14 is a graph showing an example of a driving waveform used in a driving method according to a prior art of the present invention disclosed in Japanese Patent Application Laid-Open No. SHO55-17589.
Figure 15:
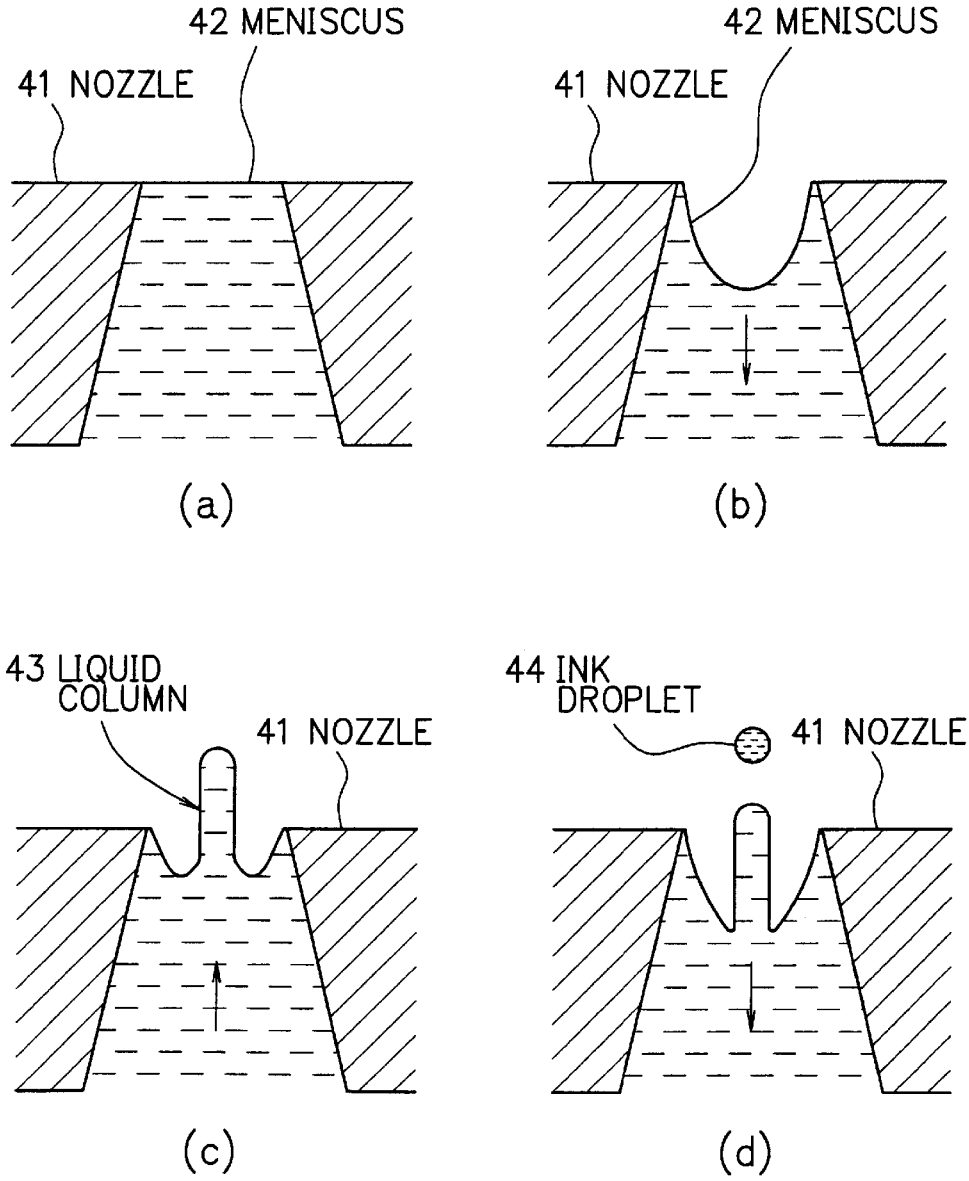
FIGS. 15(*a*) to 15(*d*) are pattern diagrams showing changes of the meniscus at the nozzle opening section when the driving waveform shown in FIG. 14 is applied.
Figure 16:
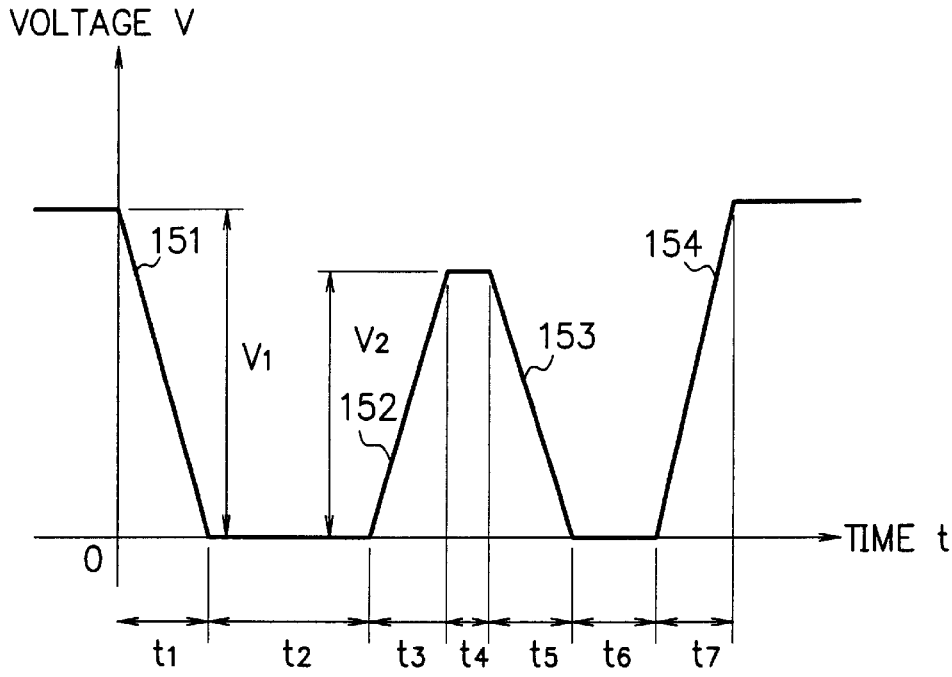
FIG. 16 is a graph showing a driving waveform in a driving method proposed in Japanese Patent Application Laid-Open No. HEI10-318443.
Figure 17:
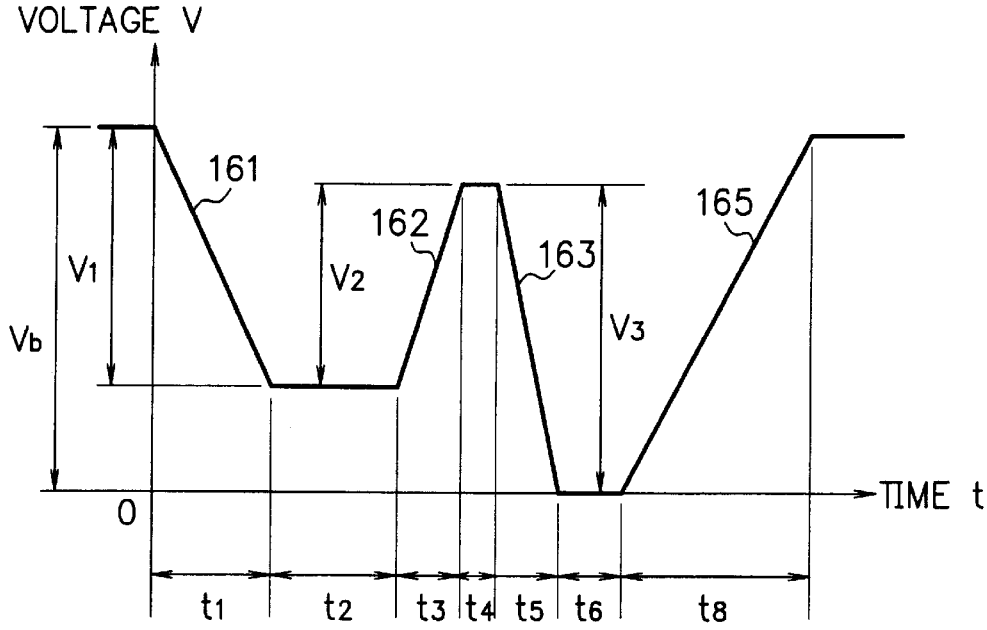
FIG. 17 is a graph showing a driving waveform in a driving method proposed in Japanese Patent Application Laid-Open No. HEI11-20613.

Next, a detailed explanation is given of an ink jet recording device in the present invention, which is actuated on the basis of the above described principle and functions in reference to FIGS. 5, 6 and 13.

In the first embodiment of the present invention, an ink jet recording head having the same basic configuration as that shown in FIG. 13 is employed.

The head is manufactured by stacking a plurality of thin plates which have been perforated by etching, etc., and bonding them with adhesive. In this embodiment, stainless plates 50 to 75 μm thick are bonded using adhesive layers (approximately 5 μm thick) of thermosetting resin.

The head is provided with a plurality of pressure generating chambers 61 (arranged in the direction perpendicular to FIG. 13) that are connected by a common ink chamber 63. The common ink chamber 63 is connected to an ink tank (not shown) and leads the ink to each of the pressure generating chambers 61.

Each pressure generating chamber 61 filled with ink is connected to the common ink chamber 63 through an ink supply channel 64. Further, each pressure generating chamber 61 is provided with a nozzle 62 for ejecting ink.

In this embodiment, the nozzle 62 has the same shape as the ink supply channel 64, both of which have a taper shape of an opening diameter of 30 μm, a bottom diameter of 65 μm, and a length of 75 μm. The perforating process is executed by press.

A diaphragm 65 is set at the bottom of the pressure generating chamber 61. The pressure generating chamber can be inflated and compressed by a piezoelectric actuator (piezoelectric vibrator) 66 set at the outside of the pressure generating chamber 61 as a driving device. In this embodiment, a nickelic thin plate formed and shaped by electroforming is employed for the diaphragm 65.

A laminated piezoelectric ceramics is employed for the piezoelectric actuator 66. The shape of a driving column for displacing the pressure generating chamber 61 is 690 μm long (L), 1.8 mm wide (W), and 120 μm long in depth (length in the direction perpendicular to FIG. 13). The density ρp of the utilized piezoelectric material is $8.0\times10^3$ kg/m$^3$, and the elastic coefficient Ep is 68 GPa. The resonance frequency $T_a$ of the piezoelectric actuator itself measured in actuality is 1.0 μs.

When the volume in the pressure generating chamber 61 is changed by the piezoelectric actuator 66, a pressure wave arises in the pressure generating chamber 61. By the pressure wave, the ink in the nozzle section 62 is exercised and is ejected outward from the nozzle 62. Thereby, an ink droplet 67 is formed.

Incidentally, the resonance frequency $T_c$ of the head used in this embodiment is 10 μs. While the value of the resonance frequency $T_c$ is not limited to the above value, if $T_c$ is too large, it becomes difficult to form a minute droplet. Thereby, in order to execute ejection of a minute ink droplet on the level of a droplet diameter of 15 to 20 μm, it is preferable to set the resonance frequency $T_c$ as $5\ \mu s<T_c\leqq15\ \mu s$.

Next, explanation will be given of a basic configuration of a driving circuit for driving the piezoelectric actuator in reference to FIGS. 5 and 6.

FIG. 5 is an example of a driving circuit (driving voltage applying means) in the case of fixing a diameter of an ejected ink droplet (in the case of not executing droplet size modulation). After generating a driving waveform signal and amplifying the electric power of the signal, the driving circuit shown in FIG. 5 supplies the signal to the piezoelectric actuator and drives the actuator. Thereby, characters and images are printed on recording paper. As shown in FIG. 5, the driving circuit comprises a waveform generating circuit 71, an amplifying circuit 72, a switching circuit (transfer gate circuit) 73, and a piezoelectric actuator 74.

The waveform generating circuit 71, which includes a digital-to-analog converting circuit and an integrating circuit, converts driving waveform data into analog data, and subsequently, performs an integration process to generate a driving waveform signal. The amplifying circuit 72 executes voltage amplification and current amplification to the driving waveform signal supplied from the waveform generating circuit 71, and outputs it as an amplified driving waveform signal. The switching circuit 73 executes on/off control of ink droplet ejection, and impresses the driving waveform signal to the piezoelectric actuator 74 according to a signal generated on the basis of image data.

FIG. 6 shows a basic configuration of a driving circuit (driving voltage applying means) in the case of switching the diameter of an ejected ink droplet between multiple levels, namely, in the case of executing droplet size modulation. In order to modulate the droplet size into three levels (large droplet, middle droplet, small droplet), the driving circuit in this example is provided with three kinds of waveform generating circuits 81, 81' and 81" depending on each of the droplet size. Each waveform is amplified by amplifying circuits 82, 82' and 82". At recording, the driving waveform applied to piezoelectric actuators (84, 84', 84" . . . ) is switched by switching circuits (83, 83', 83" . . . ) on the basis of image data, and an ink droplet of a desired size is ejected. Incidentally, the driving circuit for driving the piezoelectric actuators is not limited to the one having the configuration shown in this embodiment, and it is possible to employ a circuit having another configuration.

Next, explanation will be given of a driving method for an ink jet recording head according to the present invention in conjunction with the functions of the ink jet recording device having the above configuration in reference to FIGS. 1 to 4.

First Embodiment of Driving Method

Figure 1:
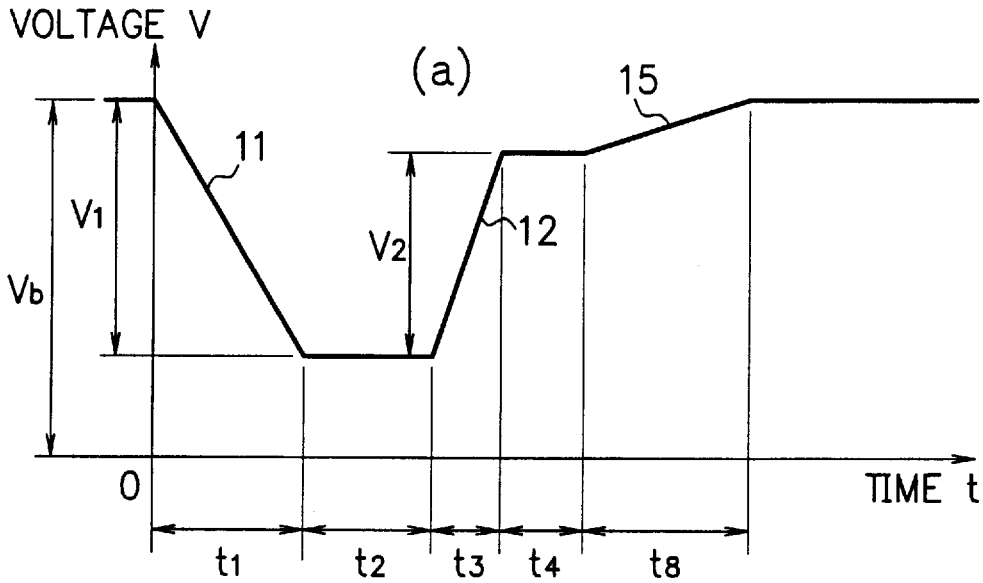
FIGS. 1(*a*) and 1(*b*) illustrates a first embodiment of the present invention.
Figure 1:
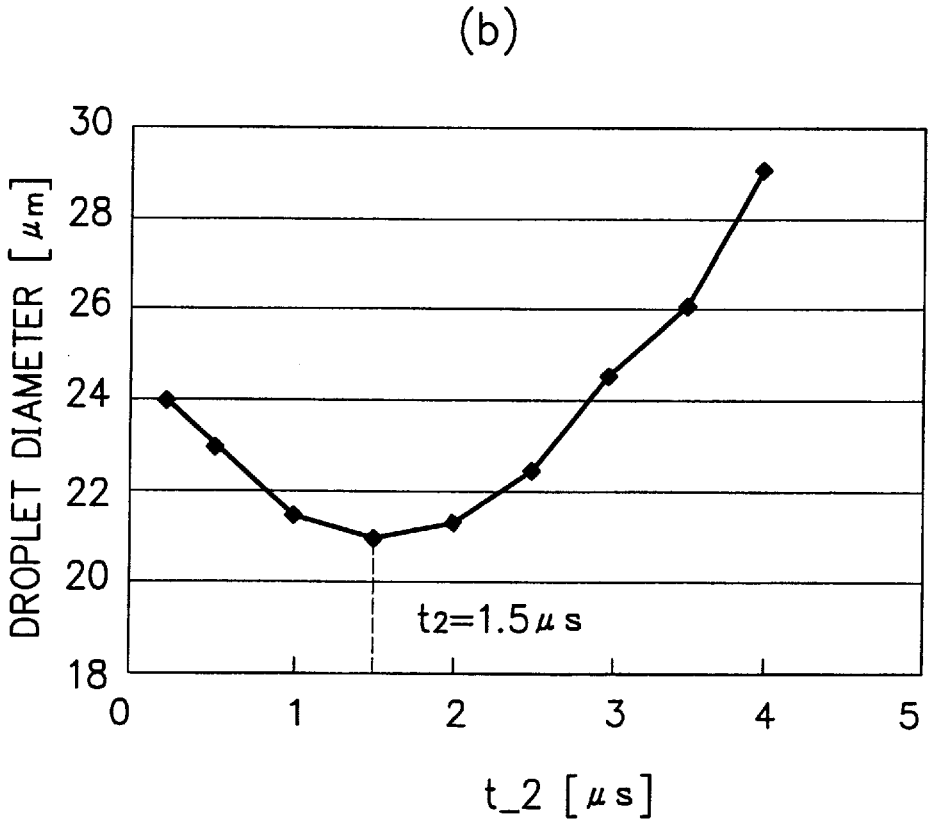

FIG. 1(*a*) is a diagram showing an example of a driving waveform used for ejecting a minute droplet having a drop diameter approximately 20 μm using the ink jet recording head described above.

The driving waveform comprises a first voltage changing process 11 for inflating the pressure generating chamber in $t_1$=2 μs, a second voltage changing process 12 for deflating the volume of the pressure generating chamber in the rising time $t_3$=1.5 μs, and a voltage changing process 15 for setting back the voltage to a reference voltage ($V_b$=25V) finally.

The time interval ($t_2$) between the finish time of the first voltage changing process and the start time of the second voltage changing process was set to 1.5 μs. This value meets the condition of the above described expression (1). Further, the voltage $V_1$ and $V_2$ were set to 15V and 12V, and the voltage changing time $t_4$ and $t_8$ were set to 6 μs and 20 μs, respectively.

As a result of ejection experiments using the driving waveform shown in FIG. 1(*a*), it was observed that an ink droplet having a droplet diameter of 22 μm was ejected at a droplet velocity 6.0 m/s. For comparison, as a result of ejection observations using the driving waveform in which $t_1$=2 μs and $t_3$=3 μs, the lower limit of the diameter of the minute droplet that could be ejected at a droplet velocity 6 m/s or more was 25 μm in spite of various adjustments for the voltage $V_1$, $V_2$, etc.

FIG. 1(*b*) shows results of examining variations of the droplet diameter in the case of changing $t_2$ in the driving waveform shown in FIG. 1(*a*).

Incidentally, $t_1$ and $V_1$ were fixed to 2 μs and 15V, respectively, and $V_2$ was adjusted so that the droplet velocity came to 6 m/s.

In reference to FIG. 1(*b*), when $t_2$ meets the condition of the expression (1) ($t_2$=1.5 μs), the droplet diameter is minimized, and thereby, it turns out that this condition is the most suitable to eject minute droplets.

Incidentally, as evidenced by FIG. 1(*b*), in executing ejection of minute droplets, it is not necessary that the condition of the expression (1) is strictly satisfied, and the effect on the minimization of the droplet diameter can be obtained if the condition of the expression (1) is approximately satisfied. To be concrete, if $t_2$ is set within ±1 μs of $t_2$ found by the expression (1), the effect on the decrease of the droplet diameter can be obtained.

Incidentally, when a time response characteristic of the driving circuit is low and rounding is generated to the driving waveform, or when an attenuation speed of the pressure wave is high, etc., there is a tendency that the optimum value of $t_2$ (condition with which the smallest droplet is obtained) becomes somewhat larger than the value found by the expression (1).

However, even in such a case, it is confirmed by the experiments by the present inventor that the optimum value of $t_2$ corresponds to the value found by the expression (1) with deviation of 3 μs or less. Therefore, it is preferable to set $t_1$ and $t_2$ so that at least the relationship of the following expression (8) can be established:

$$t_0 - t_1 - 1\mu s \leq t_2 \leq t_0 - t_1 + 3\mu s \tag{8}$$

$$t_0 = \frac{T_c}{2\pi}\tan^{-1}\left[\frac{\sin\left(\frac{2\pi}{T_c}\cdot t_1\right)}{\cos\left(\frac{2\pi}{T_c}\cdot t_1\right)-1}\right].$$

Further, it is preferable that $t_1$ satisfies the condition $0<t_1\leqq\frac{1}{2}\cdot T_c$. This is because, in the case of setting $t_1>\frac{1}{2}\cdot T_c$, the particle velocity arising at the node A shifts to positive before the particle velocities arises at the nodes B and C, and thereby, it becomes difficult to generate rapid speed change in the meniscus. Further, it is preferable that the rising time ($t_3$) of the second voltage changing process is set as short as possible so as to generate a particle velocity enough to form the liquid column in the meniscus. To be specific, it is preferable to set $t_3$ as $0<t_3 \leqq 1/3 \cdot T_c$.

As described above, by the driving waveform of FIG. 1(*a*) in which $t_1$ and $t_2$ are set so as to satisfy the expression (1), it becomes possible to obtain a minute droplet on the level of a droplet diameter of 20 μm stably.

In the driving method of the ink jet head in the present invention, there is no need to set the rising/falling time of the driving waveform to $T_a$ (resonance frequency of the piezoelectric actuator itself) or less. Thereby, the natural vibration of the piezoelectric actuator itself is not excited. Therefore, the current running into the piezoelectric actuator will not increase, and the reliability of the piezoelectric actuator will not decrease.

Incidentally, the droplet size modulation record using the driving waveform of the present invention may be realized by generating a driving waveform corresponding to a small droplet diameter at the waveform generating circuit 81 and generating driving waveforms corresponding to other droplet diameters at the waveform generating circuits 81' and 81" in the driving circuit as shown in FIG. 6.

Second Embodiment of Driving Method

Figure 2:
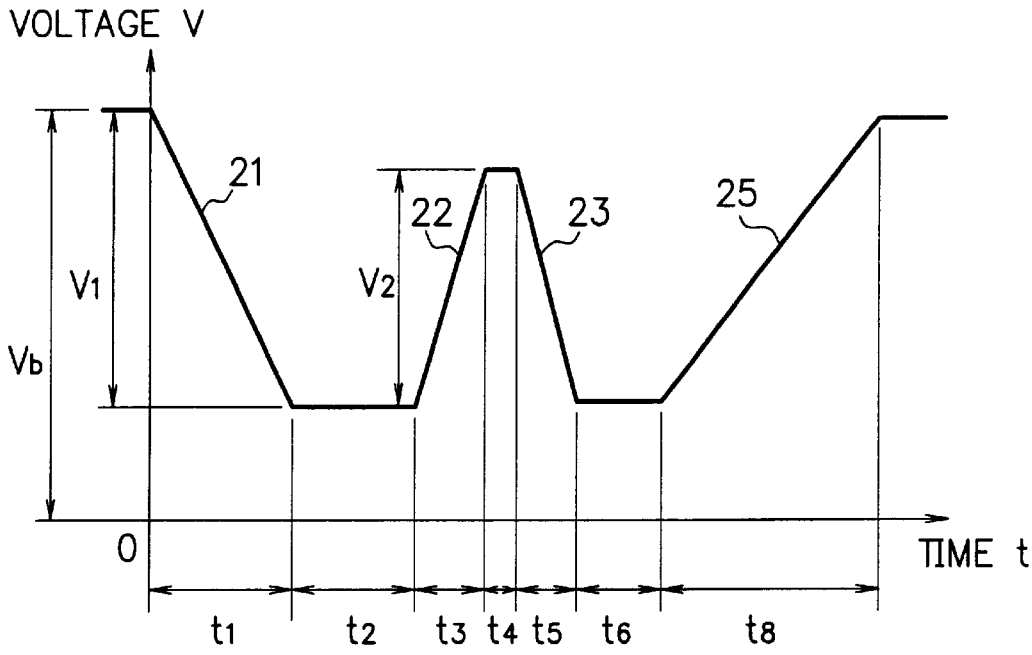
FIG. 2 shows a driving waveform of an ink jet recording head according to a second embodiment of the present invention.

FIG. 2 is a diagram showing a driving waveform used for ejecting a minute droplet with a droplet diameter less than 20 μm according to a second embodiment of the present invention.

The driving waveform comprises a first voltage changing process 21 for inflating the pressure generating chamber in $t_1$=2 μs, a second voltage changing process 22 for deflating the volume of the pressure generating chamber in the rising time $t_3$=1.5 μs, a third voltage changing process 23 for inflating the pressure generating chamber in the falling time $t_5$=1.5 μs just after the preceding process, and a voltage changing process 25 for setting back the voltage to a reference voltage ($V_b$=25V) conclusively. Further, $t_2$ was set to 1.5 μs so as to satisfy the condition of the expression (1). In addition, $t_4$, $t_6$ and $t_8$ were set to 0.2 μs, 6 μs and 20 μs, respectively. Furthermore, the voltages $V_1$ and $V_2$ were set to 15V and 12V, respectively.

The driving waveform in this embodiment is characterized by including the third voltage changing process 23 for rapidly inflating the pressure generating chamber just after the second voltage changing process 22. The third voltage changing process 23 has a function to early separate a droplet from the tip of a formed liquid column, by which smaller ink droplets can be ejected compared to the case of using the driving waveform in the first embodiment.

Actually, as a result of ejection experiments using the driving waveform of FIG. 2, it was observed that an ink droplet having a droplet diameter of 18 μm was ejected at the droplet velocity 6.2 m/s. The reason why the droplet diameter became smaller than that in the case of using the driving waveform of the first embodiment (FIG. 1(*a*)) is that the droplet was early separated by the function of the third voltage changing process as described above.

Incidentally, in order to increase the effect on the early separation of the droplet, it is preferable to set the interval ($t_4$) between the finish time of the second voltage changing process and the start time of the third voltage changing process as short as possible. To be concrete, it is preferable to set $t_4$ as $0<t_4 \leqq 1/5 \cdot T_c$. Further, in order to generate a particle velocity enough to early separate the droplet, the falling time ($t_5$) of the third voltage changing process is preferably shortened as far as possible. To be concrete, it is preferable to set $t_5$ as $0<t_5 \leqq 1/3 T_c$.

Figure 3:
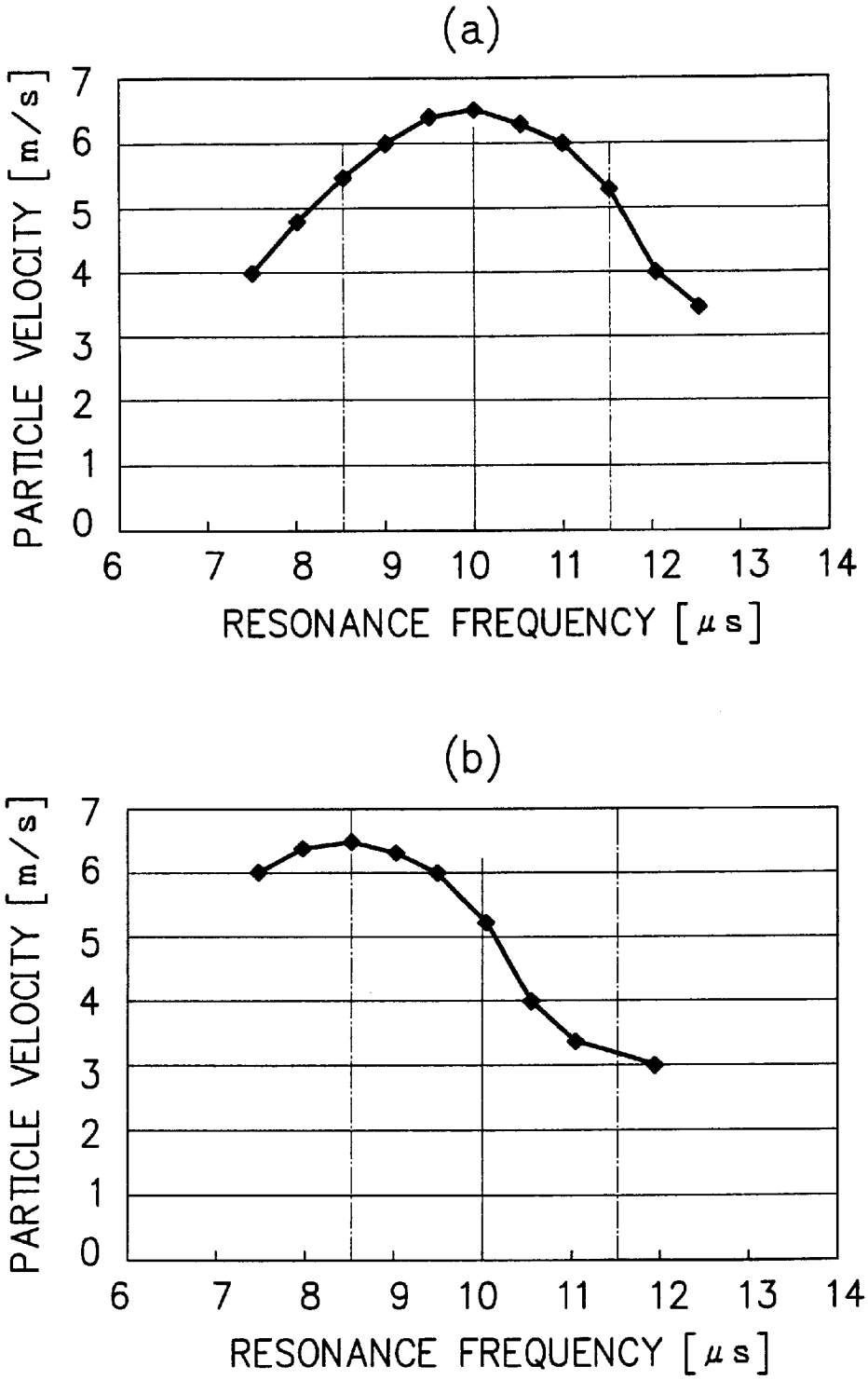
FIGS. 3(*a*) and 3(*b*) are graphs showing results of examination for a resonance frequency dependency of the driving waveform of this embodiment.

FIGS. 3(*a*) and 3(*b*) show results of examining resonance frequency dependency in the driving waveform in the second embodiment. Namely, variations of the droplet velocity were examined by impressing the driving waveform in this embodiment to a head that is manufactured so that pressure wave resonance frequency came to 7 to 13 μs. In result, it became clear that: when the resonance frequency stayed in the designed value (10 μs), the droplet velocity was maximized; when the resonance frequency was more or less than the designed value, the decrease of the droplet velocity occurred; however, if the deviation from the designed value was within a range of ±1.5 μs (in FIGS. 3(*a*) and 3(*b*), the range shown by the dashed lines), the variations of the droplet velocity was within ±1 m/s, and thereby, there is little effect on the recorded result (refer to FIG. 3(*a*)).

On the other hand, as a result of the same experiment using the driving waveform in which $t_1$=2 μs and $t_2$=3 μs, the ejection state changed largely and the recorded result was deteriorated to a large extent. For example, when the resonance frequency changed by ±1.5, a change of 3 m/s or more occurred in the droplet velocity, and a satellite having a large diameter occurred (refer to FIG. 3(*b*)).

As described above, by setting $t_1$ and $t_2$ of the driving waveform so as to satisfy the expression (1), it becomes possible to ensure insensitivity to the variations of the resonance frequency of the pressure wave, and it becomes possible to increase the manufacturing yield dramatically.

Third Embodiment of the Driving Method

FIG. 4(*a*) is a diagram showing a driving waveform used for ejecting a minute droplet having a droplet diameter of approximately 15 μm or less according to a third embodiment of the present invention.

The driving waveform comprises a first voltage changing process 31 for inflating the pressure generating chamber in $t_1$=2 μs, a second voltage changing process 32 for deflating the volume of the voltage generating chamber in the rising time $t_3$=1.5 μs, a third voltage changing process 33 for inflating the pressure generating chamber in the falling time $t_5$=1.5 μs just after the preceding process, a fourth voltage changing process 34 for compressing the pressure generating chamber in the rising time $t_7$=2 μs, and a voltage changing process 35 for setting back the voltage to a reference voltage ($V_b$=25V) eventually.

So as to satisfy the condition of the expression (1), $t_2$ was set to 1.5 μs. Further, $t_4$, $t_6$ and $t_8$ were set to 0.2 μs, 1.5 μs and 15 μs, respectively. In addition, $V_1$, $V_2$, $V_3$ and $V_4$ were set to 15V, 12V, 16V and 14V, respectively.

The driving waveform is characterized in that the voltage variation $V_3$ of the third voltage changing process 33 is set larger than the voltage variation $V_2$ of the second voltage changing process 32, and the fourth voltage changing process 34 for compressing the pressure generating chamber in the rising time $t_7$=2 μs is included just after the third voltage changing process 33.

The fourth voltage changing process has a function of eliminating the reverberation of the pressure wave arising at the first to third voltage changing processes, and thereby, stable ejection can be realized even with high driving frequency. Further, by setting $V_3>V_2$, the ink droplet can be separated from the tip of the liquid column earlier. Therefore, compared to the driving waveform of the second embodiment (FIG. 2), it becomes possible to eject minuter ink droplets.

Actually, as a result of ejection experiment using the driving waveform of FIG. 4(*a*), it was observed that an ink droplet of a droplet diameter of 16 μm was ejected at the droplet velocity 6.5 m/s.

FIG. 4(*b*) shows results of calculation of variations of the particle velocity in the case of applying the driving waveform of FIG. 4(*a*).

Due to setting $t_1$ and $t_2$ so as to satisfy the expression (1), rapid speed increase occurs in the time interval b. Further, by the function of the voltage changing process 33, rapid speed decrease occurs afterward. By this rapid speed decrease, the ink droplet is separated early, and the diameter of the ejected ink droplet decreases.

Further, in the driving waveform shown in FIGS. 1(*a*) and 2, in the case of setting the ejection frequency to 8 kHz or more, the ejecting state became somewhat unstable. On the other hand, in this driving waveform, it was confirmed that stable ejection could be realized up to 12 kHz. This is because the pressure wave reverberation was controlled by the fourth voltage changing process 34, and thereby, the pressure wave generated at the preceding ejection had no effect on the next ejection. Also in the analysis result of FIG. 4(*b*), it is shown that the variations of the particle velocity become very small in the time interval b.

Further, by the use of this driving waveform, it was confirmed that the flying characteristic (ejecting direction, etc.) of the droplet was improved. This is because the pressure wave reverberation was controlled, and thereby, the meniscus just after ejection became stable and the flying state (ejecting direction, etc.) of the satellite became stable/uniformed.

Incidentally, in order to efficiently control the reverberation, it is necessary to control the reverberation just after the ejection. For that purpose, $t_6$ is preferably set as short as possible. To be concrete, $t_6$ is preferably set as $0<t_6\leqq\frac{1}{3}T_c$. Further, in order to efficiently generate a pressure wave for the control of the reverberation, the rising time ($t_7$) of the fourth voltage changing process 34 is preferably set as short as possible, in particular, set as $0<t_7\leqq\frac{1}{2}T_c$.

In the above description, while each of the embodiments was explained, the present invention will not be limited to the above described configurations of the embodiments.

For example, in the foregoing embodiments, the bias voltage (reference voltage) $V_b$ was set so that the applied voltage to the piezoelectric actuator always came to positive polarity. However, when it is permitted to apply negative polar voltage to the piezoelectric actuator, the bias voltage $V_b$ may be set to another voltage such as 0V.

Further, a piezoelectric actuator of longitudinal vibration mode utilizing piezoelectric constant $d_{33}$ was employed for the piezoelectric actuator. However, it is also possible to employ actuators of other configurations such as an actuator of longitudinal vibration mode utilizing piezoelectric constant $d_{31}$.

In addition, a laminated piezoelectric actuator was employed in the above embodiments. However, the same effect can be obtained also in the case of using a single plate piezoelectric actuator. Further, it is possible to apply the present invention to other driving devices other than a piezoelectric actuator, such as an ink jet recording head having an actuator utilizing electrostatic force and magnetic force.

Further, a Kyser-type ink jet recording head as shown in FIG. 13 was employed in the above embodiments. However, it is also possible to apply the present invention to ink jet recording heads having other configurations, such as a recording head in which grooves set to piezoelectric actuators serve as pressure generating chambers.

Further, in the above embodiments, an ink jet recording device ejecting colored ink on recording paper and recording characters and images was taken as an example. However, the ink jet record in this specification will not be limited to the record of characters and images on the recording paper.

Namely, the recording medium will not be limited to paper, and liquid to be ejected will not be restricted to the colored ink. It is also possible to apply the present invention to general liquid droplet ejecting devices to be industrially used, for example, for manufacturing color filters for displays by ejecting colored ink on polymer films and glass, and for forming bumps for implementing components by ejecting solder in a molten state on substrates.

Industrial Applicability

As set forth hereinabove, according to the present invention, it becomes possible to eject minute droplets on the level of a droplet diameter of 15 μm, which has been difficult to realize, without causing the increase of the device cost and size and deterioration of the device reliability. Furthermore, it becomes possible to increase robustness for production variations, and to improve the manufacturing yield dramatically.

What is claimed is:

1. A driving method for an ink jet recording head which comprises the steps of applying driving voltage to a driving device, generating a pressure change in a pressure generating chamber filled with ink by a drive of the driving device, and ejecting an ink droplet from a nozzle connected to the pressure generating chamber by the pressure change, the method being characterized in that:

a voltage waveform of the driving voltage at least comprises a first voltage changing process for inflating the volume of the pressure generating chamber and a second voltage changing process for deflating the volume of the pressure generating chamber after the first voltage changing process; and a voltage changing time $t_1$ of the first voltage changing process and a time interval $t_2$ between the finish time of the first voltage changing process and the start time of the second voltage changing process are set so as to almost satisfy the following relational expression:

$$t_2 = t_0 - t_1$$

$$t_0 = \frac{T_c}{2\pi}\tan^{-1}\left[\frac{\sin\left(\frac{2\pi}{T_c}\cdot t_1\right)}{\cos\left(\frac{2\pi}{T_c}\cdot t_1\right)-1}\right]$$

($T_c$: pressure wave resonance frequency in a pressure generating chamber).

2. A driving method for an ink jet recording head, in the driving method for an ink jet recording head claimed in claim 1, characterized in that the time interval $t_2$ is set so as to satisfy the following relational expression:

$$t_0-t_1-1\ \mu s\leqq t_2\leqq t_0-t_1+3\ \mu s.$$

3. The driving method for an ink jet recording head according to claim 2, characterized by setting the voltage changing time $t_1$ of the first voltage changing process to one half or less of the resonance frequency $T_c$.

4. The driving method for an ink jet recording head according to claim 2, characterized by setting a voltage changing time of the second voltage changing process to one third or less of the resonance frequency $T_c$.

5. The driving method for an ink jet recording head according to claim 2, characterized in that the voltage waveform of the driving voltage includes a third voltage changing process for inflating the volume of the pressure generating chamber just after the second voltage changing process.

6. The driving method for an ink jet recording head according to claim 1, characterized by setting the voltage changing time $t_1$ of the first voltage changing process to one half or less of the resonance frequency $T_c$.

7. The driving method for an ink jet recording head according to claim 6, characterized by setting a voltage changing time of the second voltage changing process to one third or less of the resonance frequency $T_c$.

8. The driving method for an ink jet recording head according to claim 6, characterized in that the voltage waveform of the driving voltage includes a third voltage changing process for inflating the volume of the pressure generating chamber just after the second voltage changing process.

9. The driving method for an ink jet recording head according to claim 1, characterized by setting a voltage changing time of the second voltage changing process to one third or less of the resonance frequency $T_c$.

10. The driving method for an ink jet recording head according to claim 9, characterized in that the voltage waveform of the driving voltage includes a third voltage changing process for inflating the volume of the pressure generating chamber just after the second voltage changing process.

11. The driving method for an ink jet recording head according to claim 1, characterized in that the voltage waveform of the driving voltage includes a third voltage changing process for inflating the volume of the pressure generating chamber just after the second voltage changing process.

12. The driving method for an ink jet recording head as claimed in claim 11, characterized by setting a voltage changing time of the third voltage changing process to one third or less of the resonance frequency $T_c$.

13. The driving method for an ink jet recording head according to claim 12, characterized by setting a time interval between the finish time of the second voltage changing process and the start time of the third voltage changing process to one fifth or less of the resonance frequency $T_c$.

14. The driving method for an ink jet recording head according to claim 12, characterized by setting voltage variations in the third voltage changing process larger than voltage variations in the second voltage changing process.

15. The driving method for an ink jet recording head according to claim 12, characterized in that the voltage waveform of the driving voltage includes a fourth voltage changing process for deflating the volume of the pressure generating chamber just after the third voltage changing process.

16. The driving method for an ink jet recording head according to claim 11, characterized by setting a time interval between the finish time of the second voltage changing process and the start time of the third voltage changing process to one fifth or less of the resonance frequency $T_c$.

17. The driving method for an ink jet recording head according to claim 16, characterized by setting voltage variations in the third voltage changing process larger than voltage variations in the second voltage changing process.

18. The driving method for an ink jet recording head according to claim 16, characterized in that the voltage waveform of the driving voltage includes a fourth voltage changing process for deflating the volume of the pressure generating chamber just after the third voltage changing process.

19. The driving method for an ink jet recording head according to claim 11, characterized by setting voltage variations in the third voltage changing process larger than voltage variations in the second voltage changing process.

20. The driving method for an ink jet recording head according to claim 19, characterized in that the voltage waveform of the driving voltage includes a fourth voltage changing process for deflating the volume of the pressure generating chamber just after the third voltage changing process.

21. The driving method for an ink jet recording head according to claim 11, characterized in that the voltage waveform of the driving voltage includes a fourth voltage changing process for deflating the volume of the pressure generating chamber just after the third voltage changing process.

22. The driving method for an ink jet recording head according to claim 21, characterized by setting a voltage changing time of the fourth voltage changing process to one half or less of the resonance frequency $T_c$.

23. An ink jet recording device for recording characters and images using an ink jet recording head having a driving voltage applying means applying a predetermined driving voltage to a driving device, generating a pressure change in a pressure generating chamber filled with ink by a drive of the driving device according to the driving voltage applied by the driving voltage applying means, and ejecting an ink droplet from a nozzle connected to the pressure generating chamber, the device being characterized in that:

the driving voltage applying means is configured so as to apply a driving voltage to the driving device, the driving voltage being based on a voltage waveform at least including a first voltage changing process for inflating the volume of the pressure generating chamber and a second voltage changing process for subsequently deflating the volume of the pressure generating chamber; and a voltage changing time $t_1$ of the first voltage changing process and a time interval $t_2$ between the finish time of the first voltage changing process and the start time of the second voltage changing process are set so as to satisfy the following relational expression:

$$t_2 = t_0 - t_1$$

$$t_0 = \frac{T_c}{2\pi}\tan^{-1}\left[\frac{\sin\left(\frac{2\pi}{T_c}\cdot t_1\right)}{\cos\left(\frac{2\pi}{T_c}\cdot t_1\right)-1}\right]$$

($T_c$: pressure wave resonance frequency in a pressure generating chamber).

24. An ink jet recording device, in the ink jet recording device claimed in claim 23, characterized in that the time interval $t_2$ is set so as to satisfy the following relational expression:

$$t_0-t_1-1\ \mu s \leqq t_2 \leqq t_0-t_1+3\ \mu s.$$

25. The ink jet recording device according to claim 24, characterized in that the resonance frequency $T_c$of the pressure wave is 15 $\mu$s or less.

26. The ink jet recording device according to claim 24, characterized in that the driving device includes a piezoelectric vibrator.

27. The ink jet recording device according to claim 23, characterized in that the resonance frequency $T_c$ of the pressure wave is 15 $\mu$s or less.

28. The ink jet recording device according to claim 27, characterized in that the driving device includes a piezoelectric vibrator.

29. The ink jet recording device according to claim 23, characterized in that the driving device includes a piezoelectric vibrator.

* * * * *